US011753721B2

(12) United States Patent
Lee et al.

(10) Patent No.: US 11,753,721 B2
(45) Date of Patent: Sep. 12, 2023

(54) TRANSITION-METAL CHALCOGENIDE THIN FILM AND PREPARING METHOD OF THE SAME

(71) Applicant: RESEARCH & BUSINESS FOUNDATION SUNGKYUNKWAN UNIVERSITY, Suwon-si (KR)

(72) Inventors: Changgu Lee, Seoul (KR); Hyonggoo Yoo, Seoul (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 0 days.

(21) Appl. No.: 17/116,053

(22) Filed: Dec. 9, 2020

(65) Prior Publication Data

US 2021/0172065 A1 Jun. 10, 2021

(30) Foreign Application Priority Data

Dec. 9, 2019 (KR) ..... 10-2019-0162621

(51) Int. Cl.

| | |
|---|---|
| ***C23C 18/14*** | (2006.01) |
| ***C23C 18/12*** | (2006.01) |
| ***C23C 18/06*** | (2006.01) |
| ***C23C 18/04*** | (2006.01) |

(52) U.S. Cl.

CPC ..... *C23C 18/143* (2019.05); *C23C 18/04* (2013.01); *C23C 18/06* (2013.01); *C23C 18/1204* (2013.01); *C23C 18/125* (2013.01); *C23C 18/1245* (2013.01)

(58) Field of Classification Search

CPC .. C23C 18/143; C23C 18/1204; C23C 18/125
See application file for complete search history.

(56) References Cited

U.S. PATENT DOCUMENTS

2005/0009225 A1* 1/2005 Mitzi ..... H01L 21/02568 438/59
2007/0166645 A1* 7/2007 Jeong ..... C23C 2/04 430/270.13
2009/0191483 A1* 7/2009 Rudolph ..... G03F 1/68 250/503.1

FOREIGN PATENT DOCUMENTS

KR 10-2007-0080723 A 8/2007
KR 20070080723 A * 8/2007
KR 10-1623791 B1 5/2016
KR 10-2019-0121632 A 10/2019

OTHER PUBLICATIONS

Simonds et al "Laser processing for thin film chalcogenide photovoltaics: a review and prospectus" J. Phontonics for Energy, vol. 5 2015, 050999-1-20 (Year: 2015).*
Liu et al "Growth of Large-Area and Highly Crystalline MoS2 Thin layers on Insulating substrates" Nano Lett. 2012 12, 1538-1544. (Year: 2012).*
Korean Office Action dated Jul. 6, 2021 in counterpart Korean Patent Application No. 10-2019-0162621 (4 pages in Korean).

* cited by examiner

*Primary Examiner* — Nathan H Empie
(74) *Attorney, Agent, or Firm* — NSIP Law

(57) ABSTRACT

A method of manufacturing transition metal chalcogenide thin films, includes the operations of forming a transition metal chalcogenides precursor on a substrate, and irradiating light onto the transition metal chalcogenides precursor. The transition metal chalcogenides precursor includes an amine-based ligand.

15 Claims, 26 Drawing Sheets

[FIG. 1]
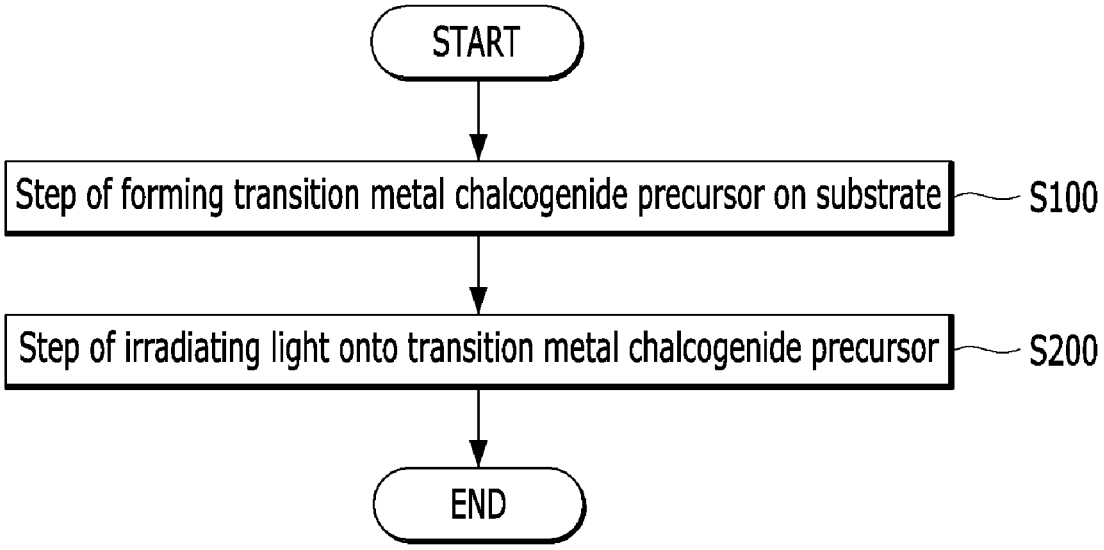

[FIG. 2]
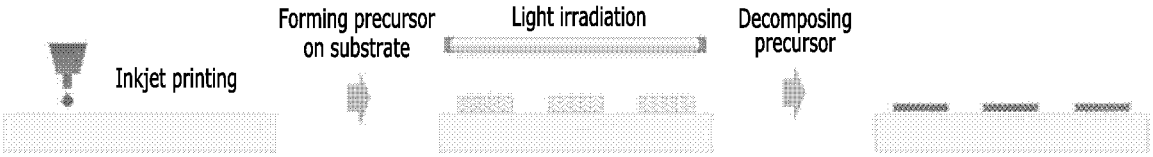

[FIG. 3]
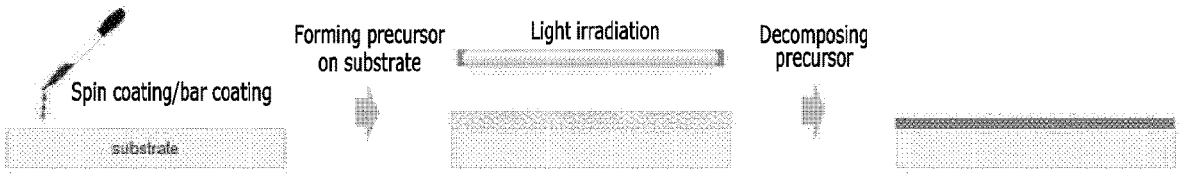

[FIG. 4]
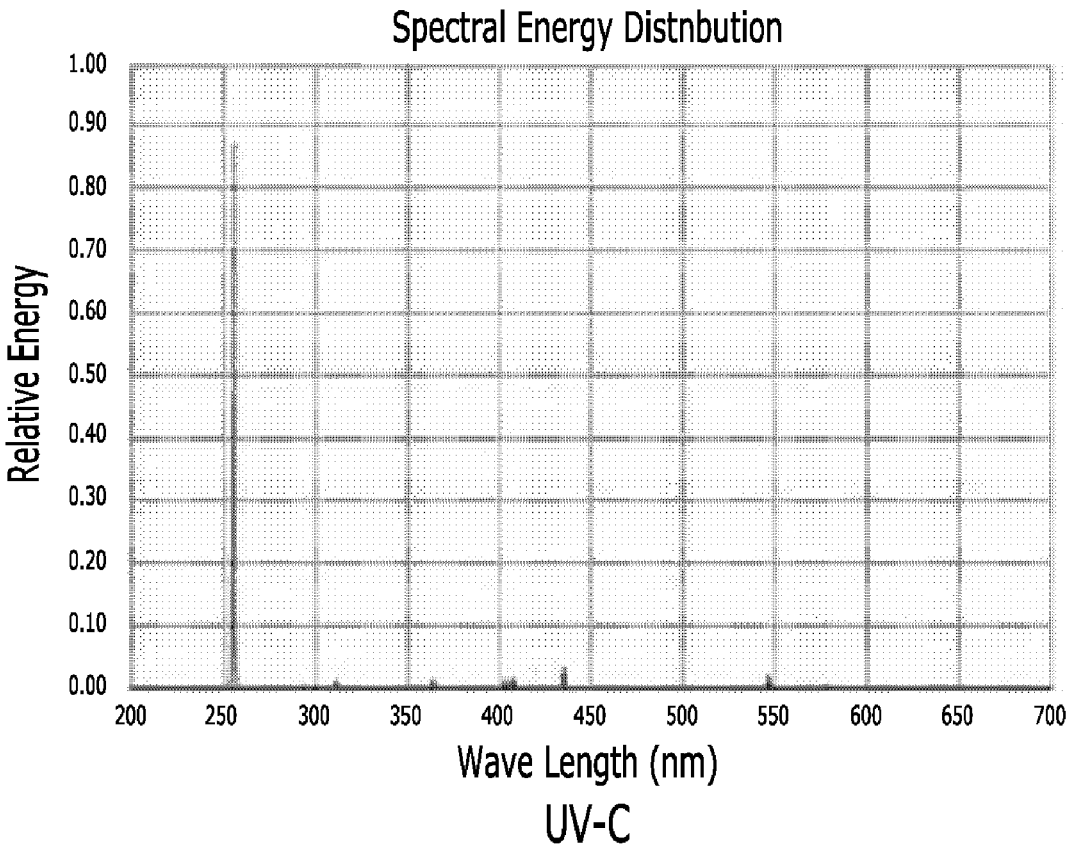

[FIG. 5]
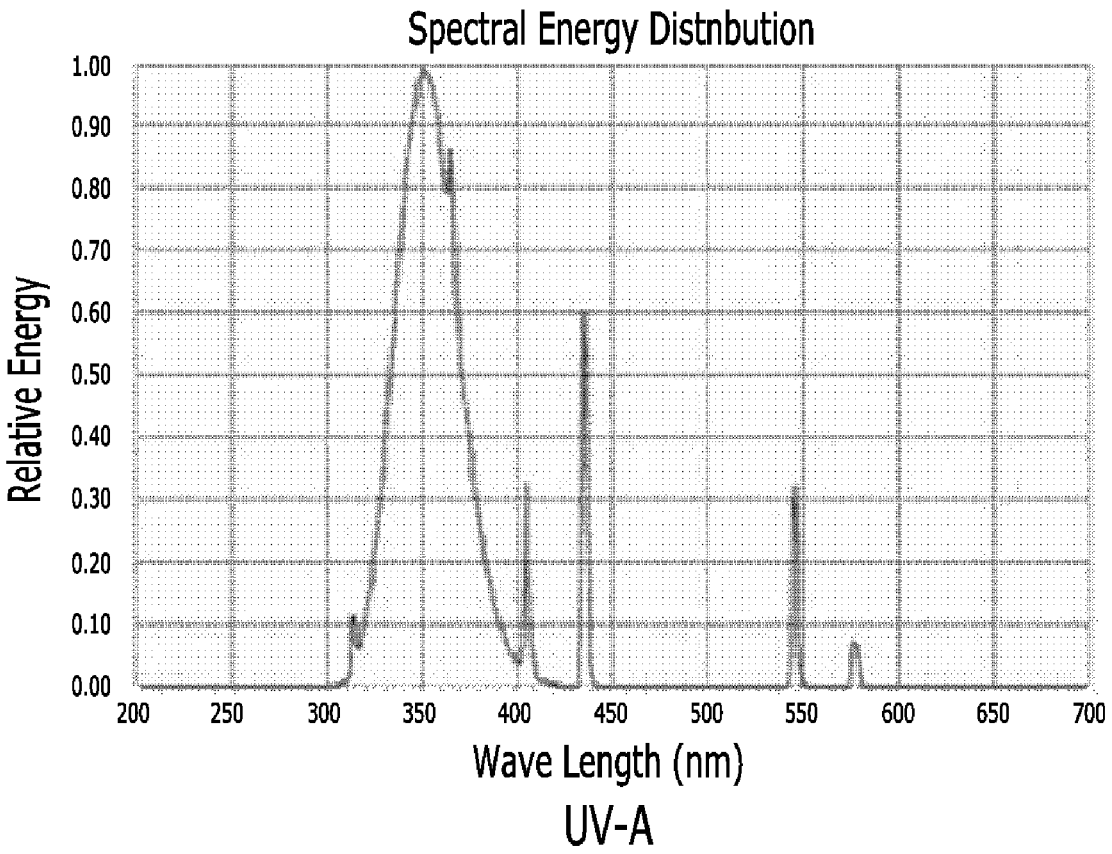

[FIG. 6]
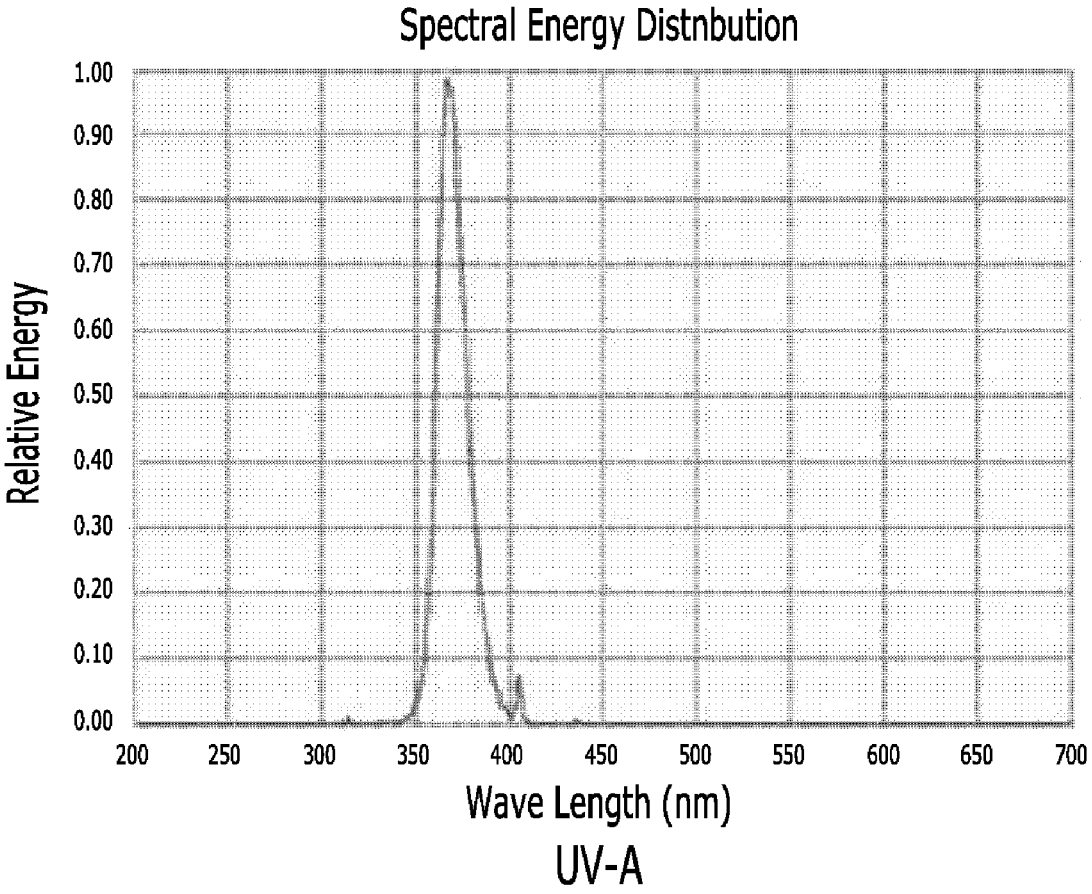

[FIG. 7]
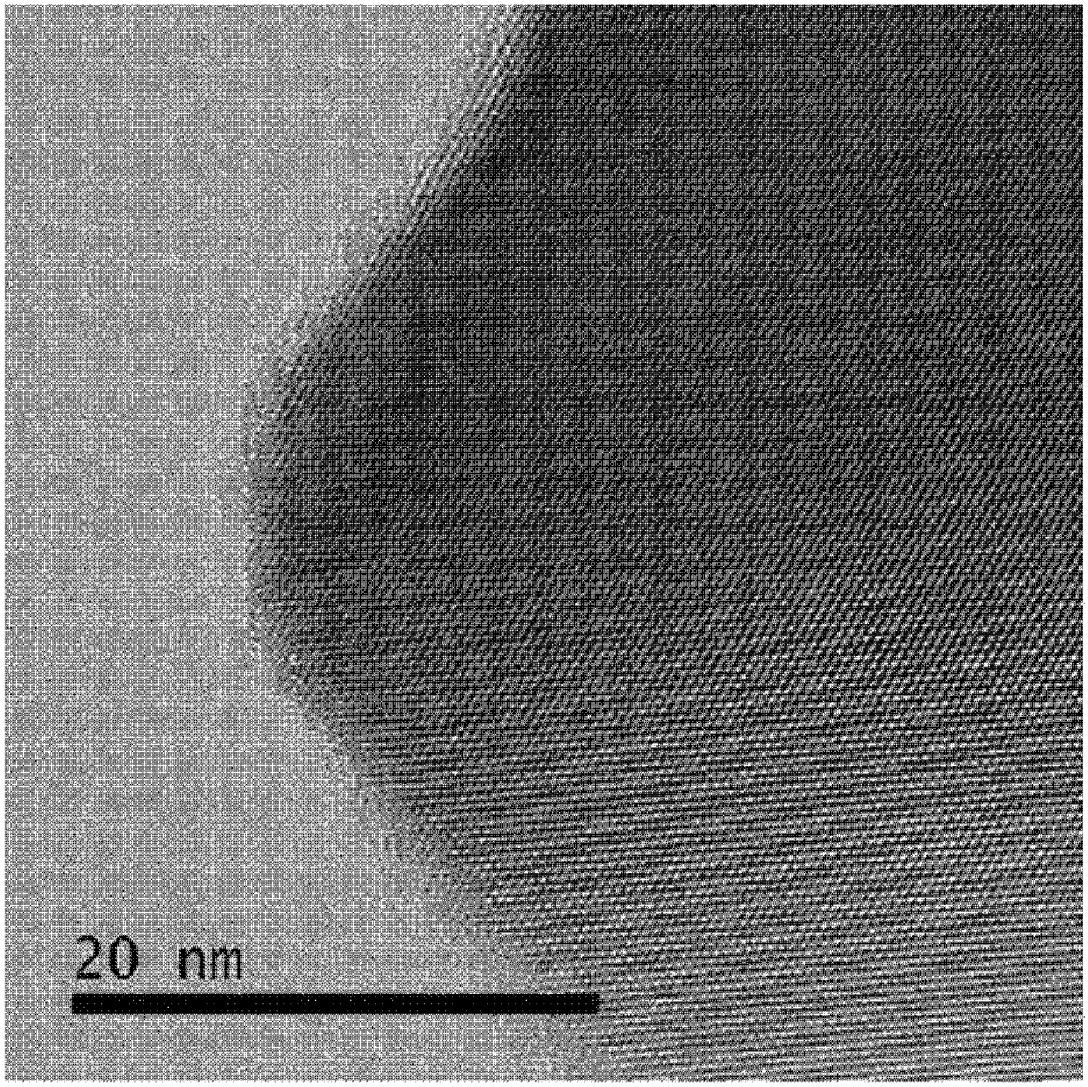

[FIG. 8]
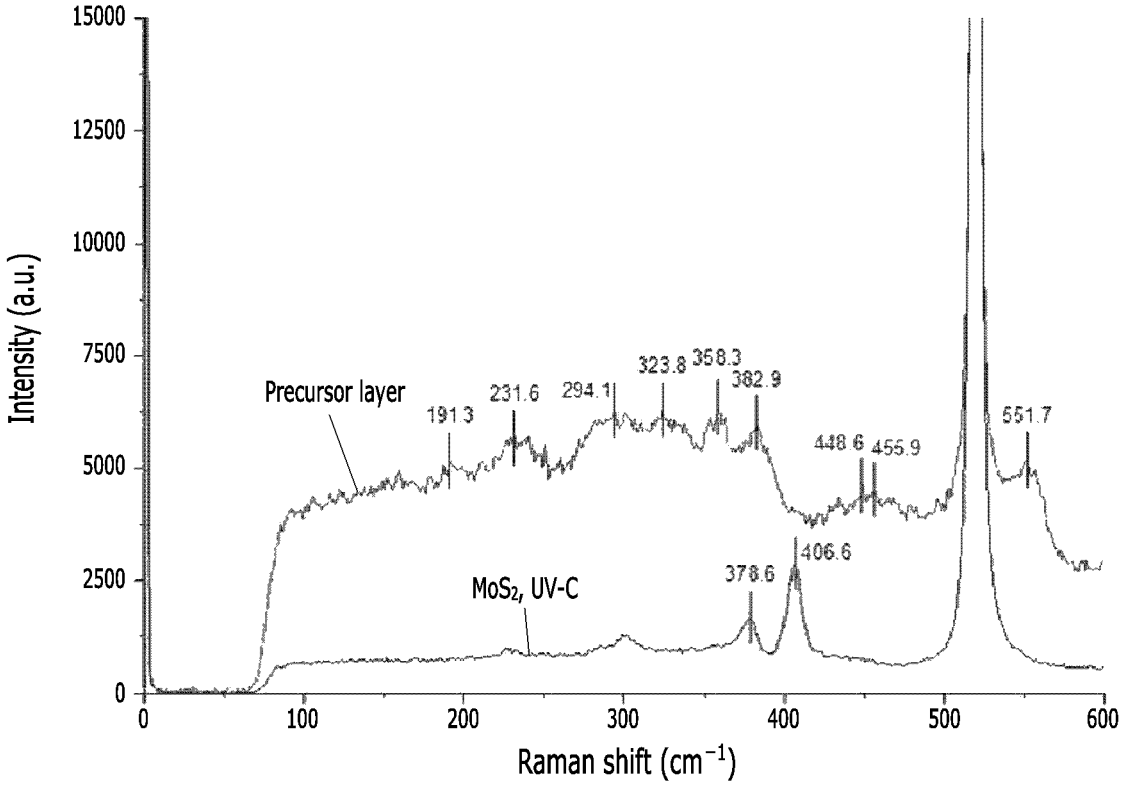

[FIG. 9]
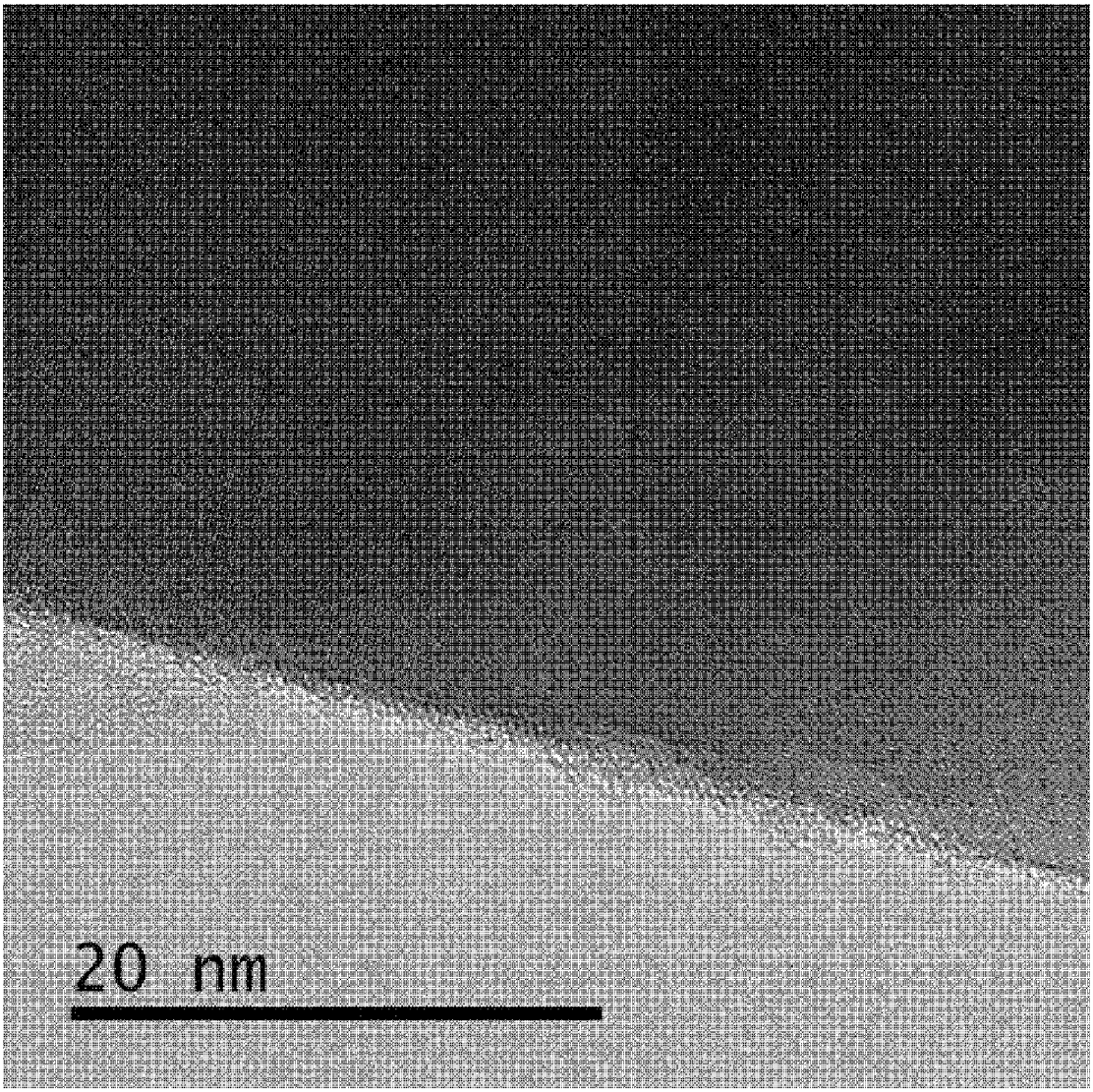

[FIG. 10]
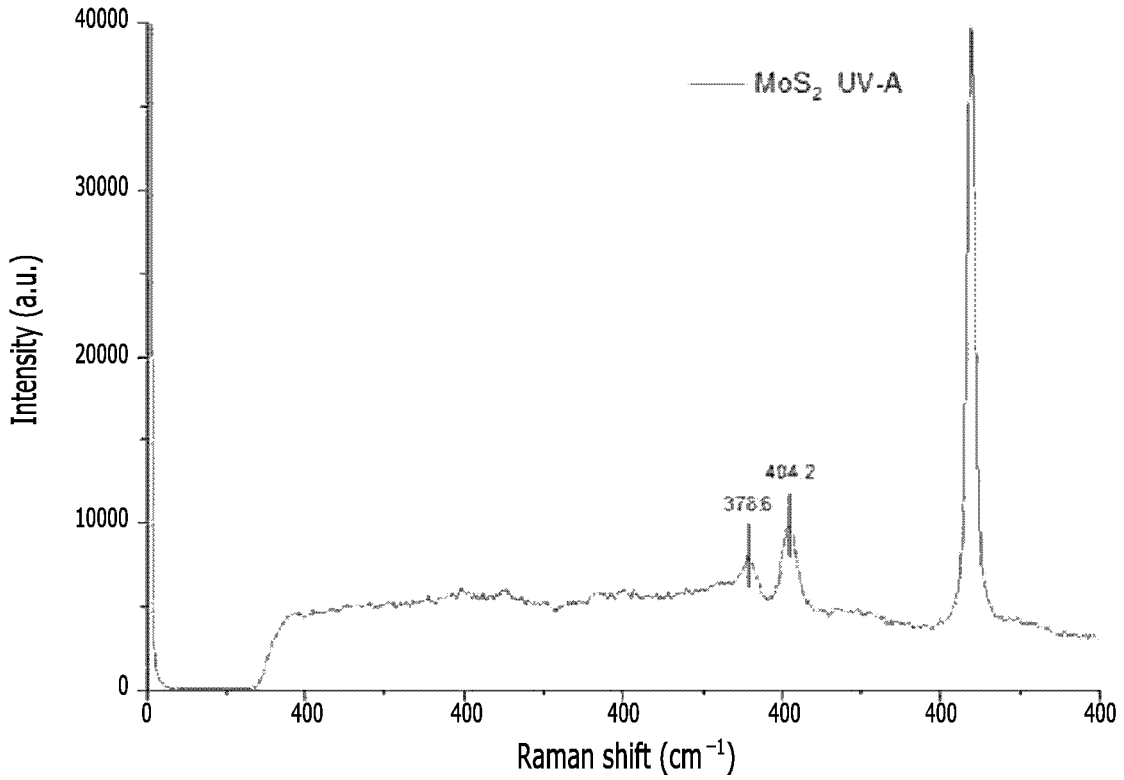

[FIG. 11]
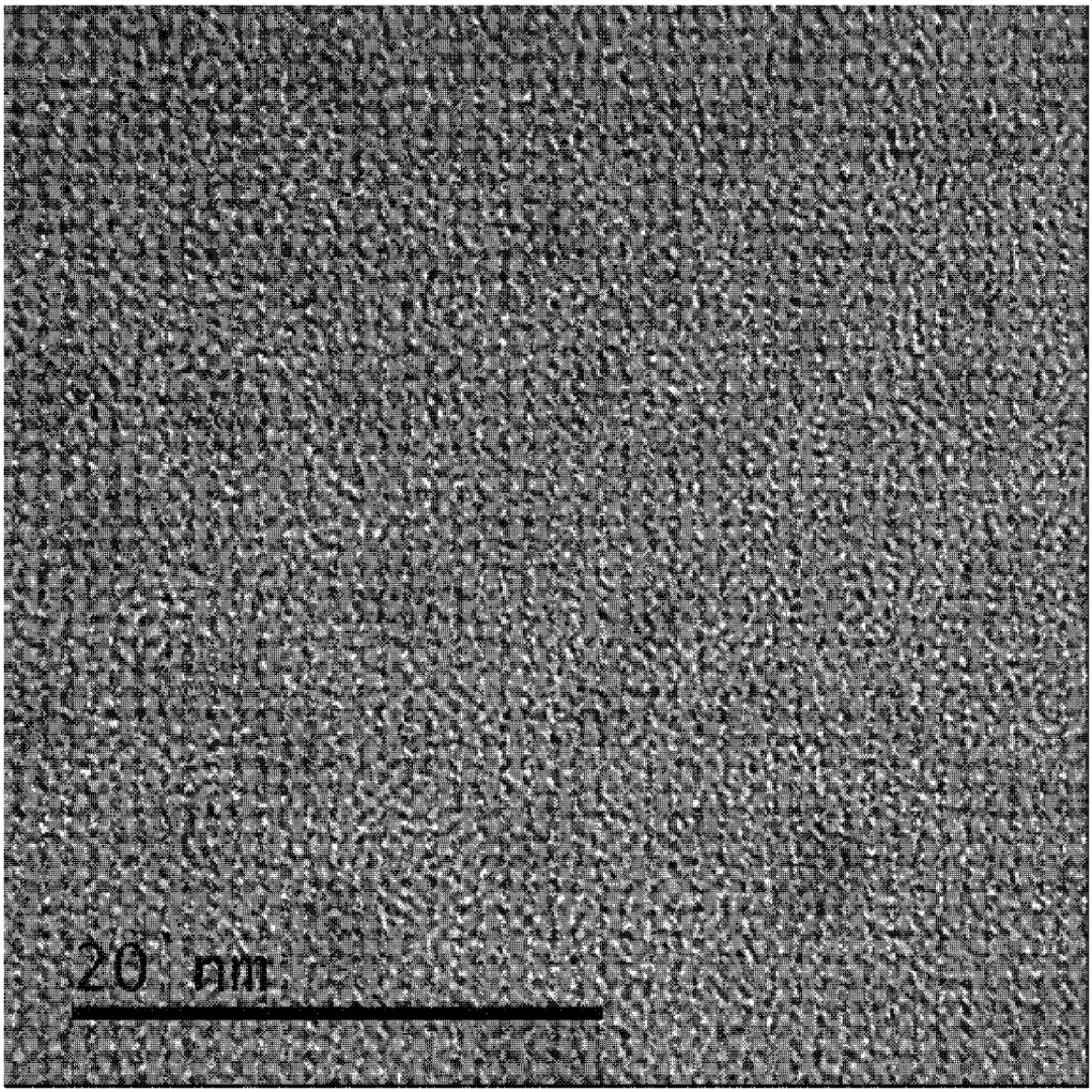

[FIG. 12]
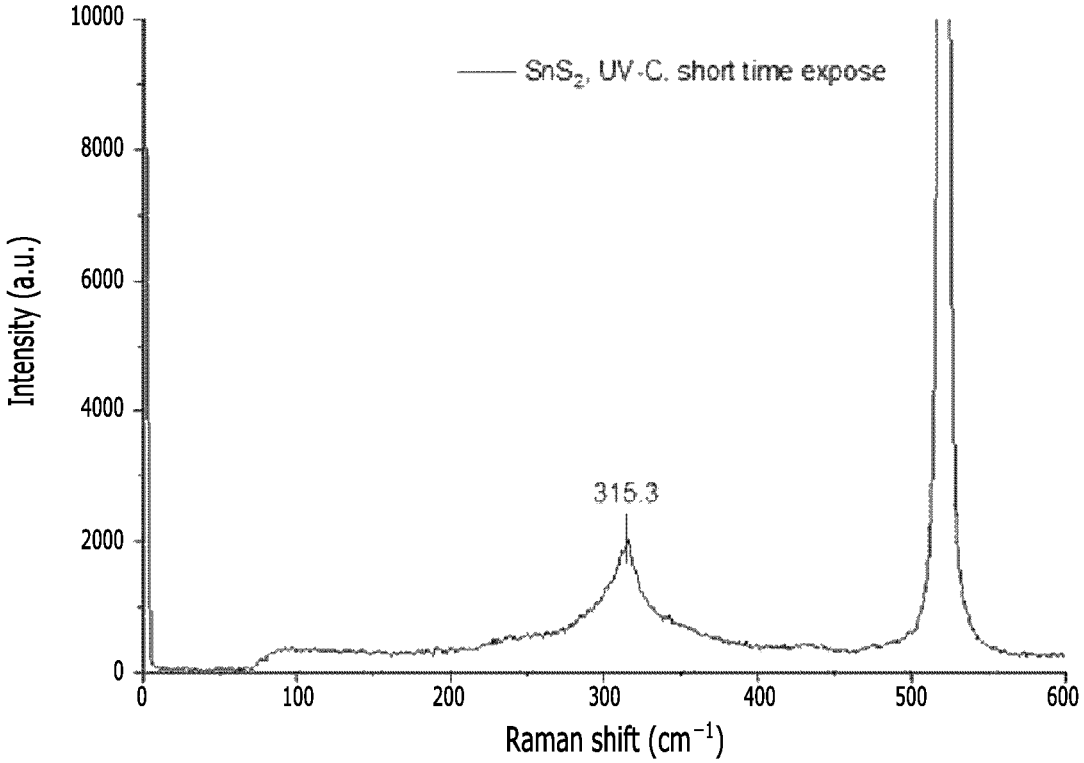

[FIG. 13]
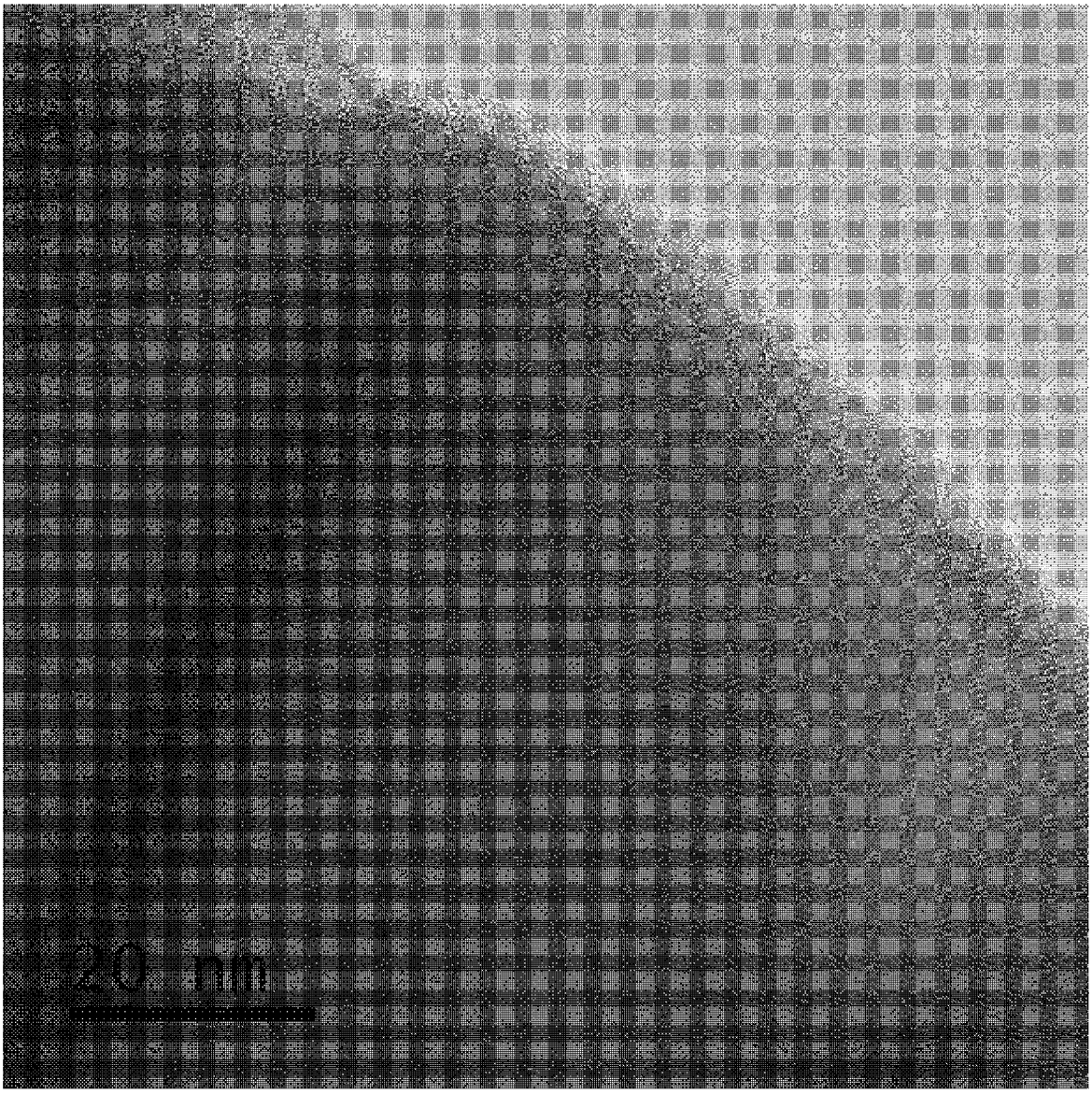

[FIG. 14]
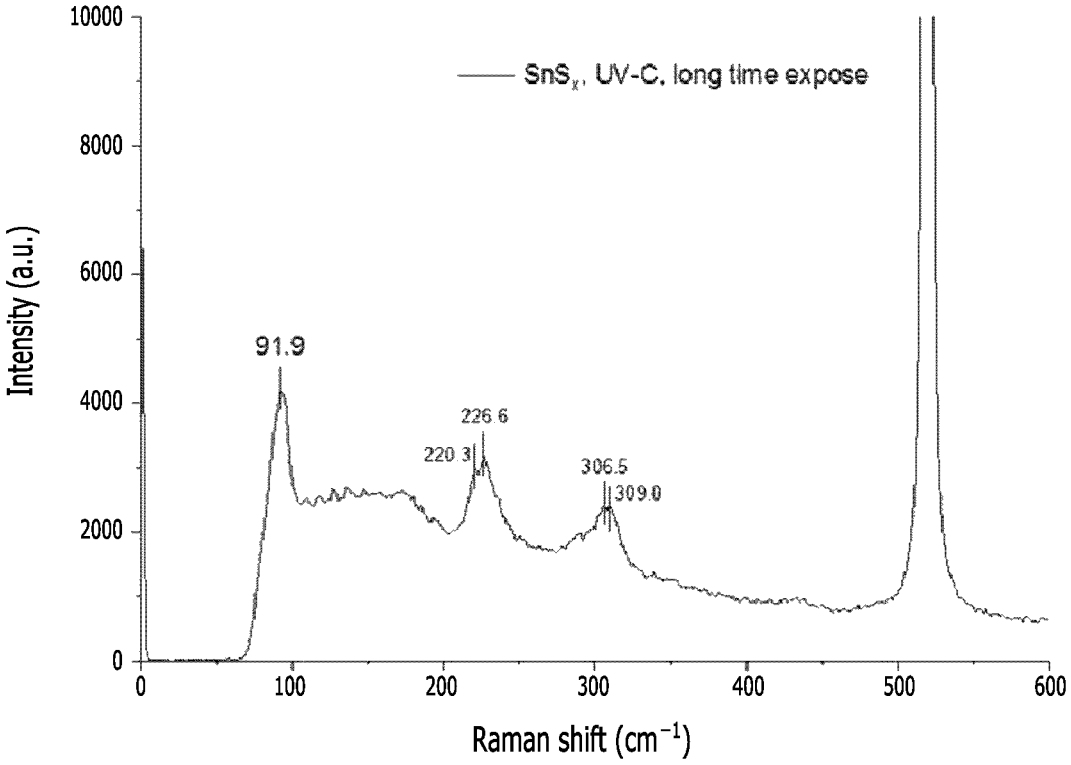

[FIG. 15]
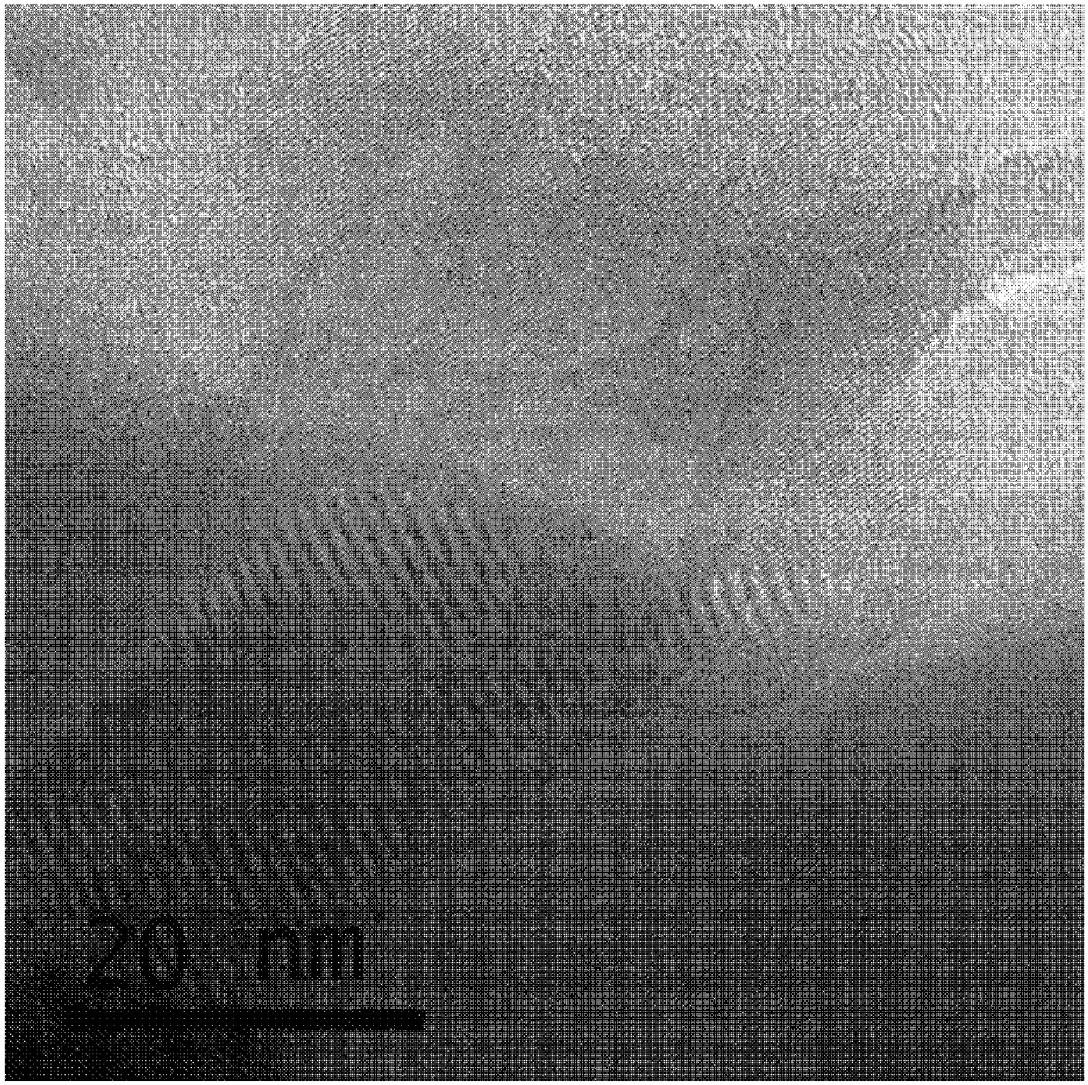

[FIG. 16]
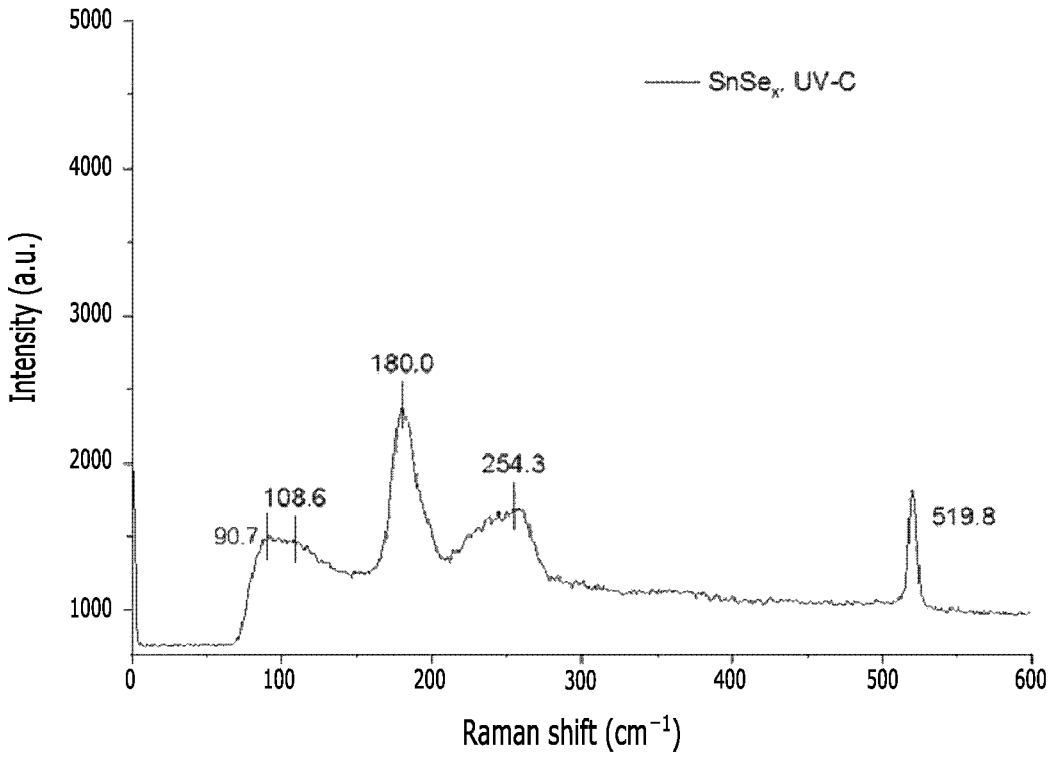

[FIG. 17]
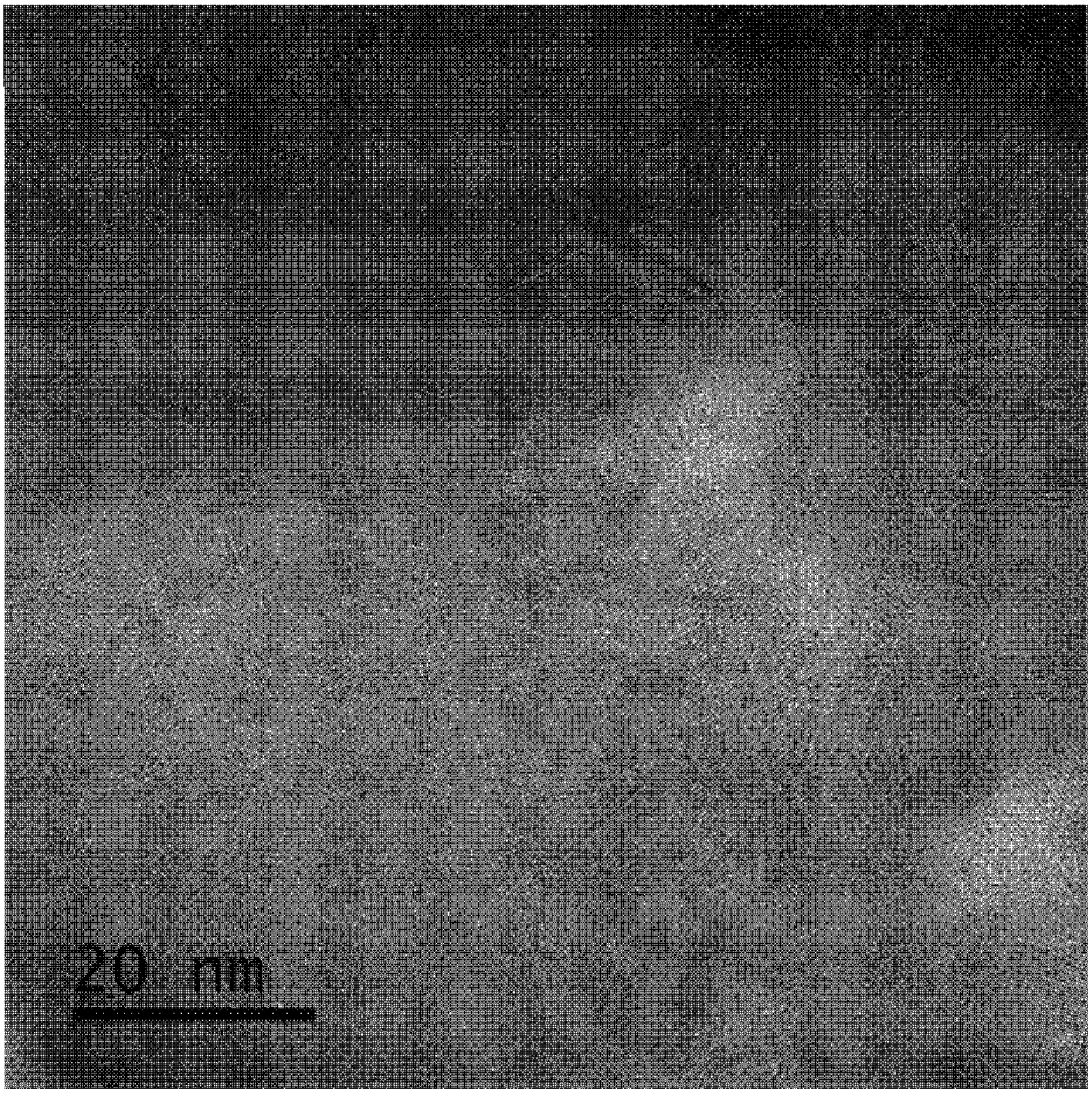

[FIG. 18]
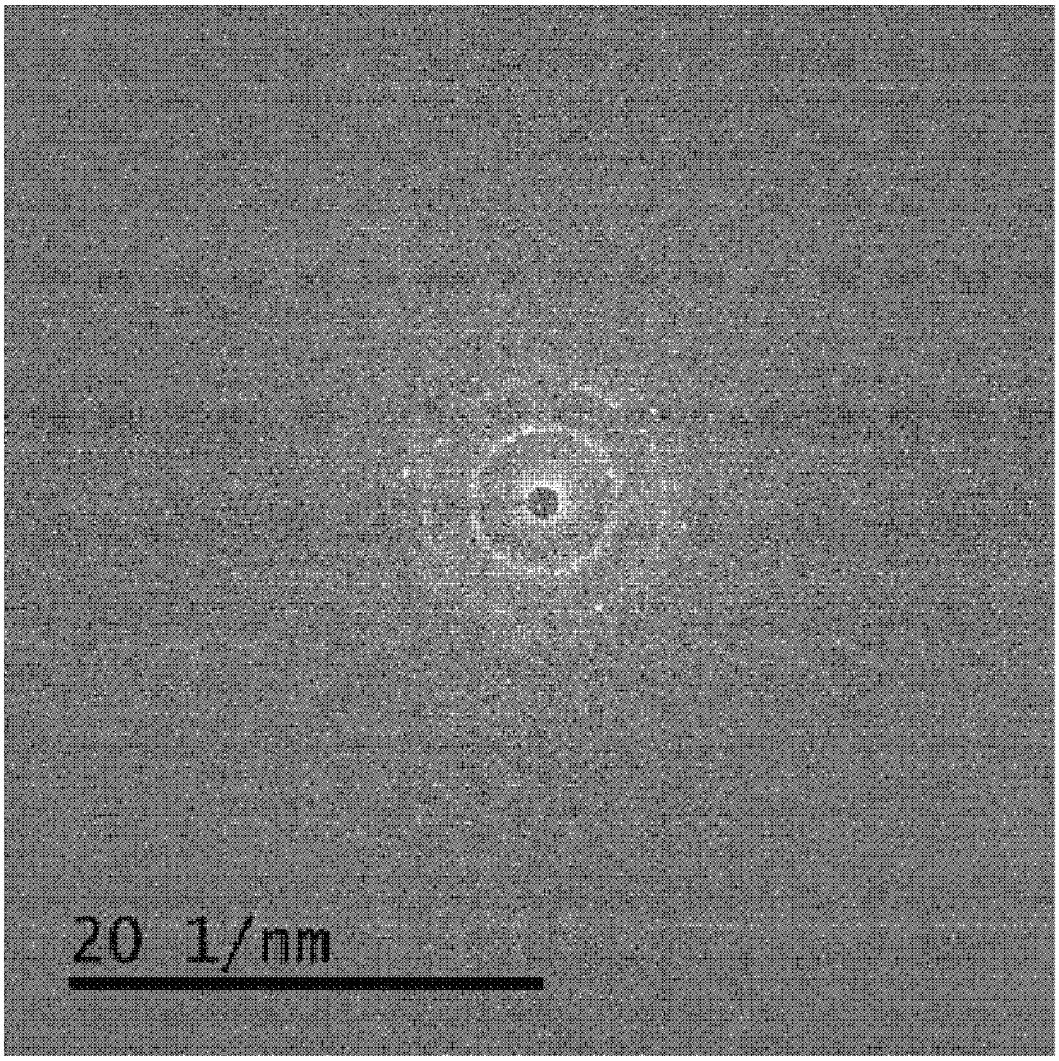

[FIG. 19]
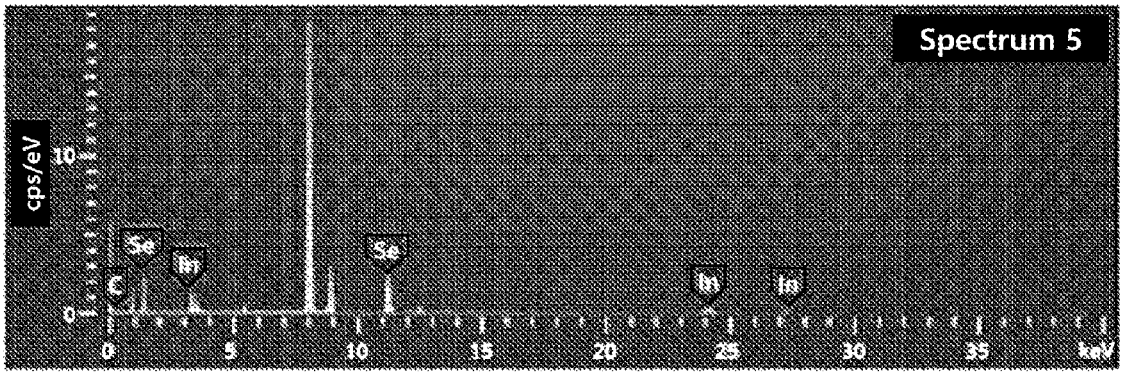
| Element | Line Type | Wt% |
|---|---|---|
| C | K series | 1.59 |
| Se | L series | 44.34 |
| In | L series | 54.07 |
| Total: | | 100.00 |

[FIG. 20]
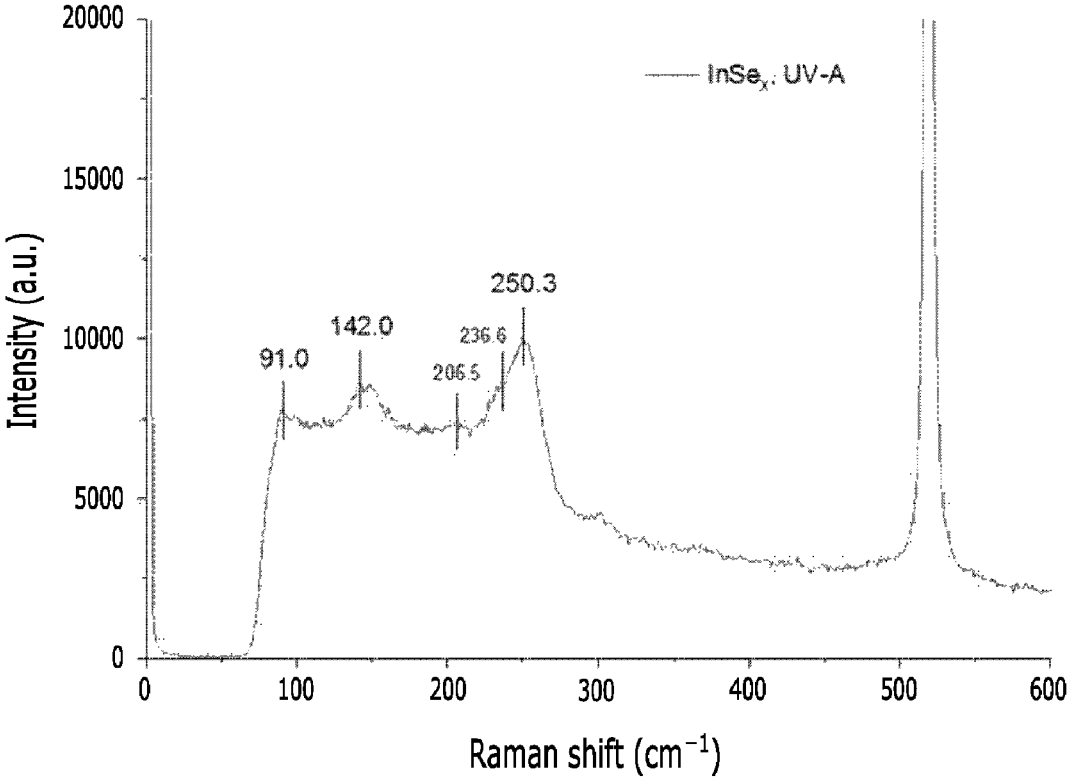

[FIG. 21]
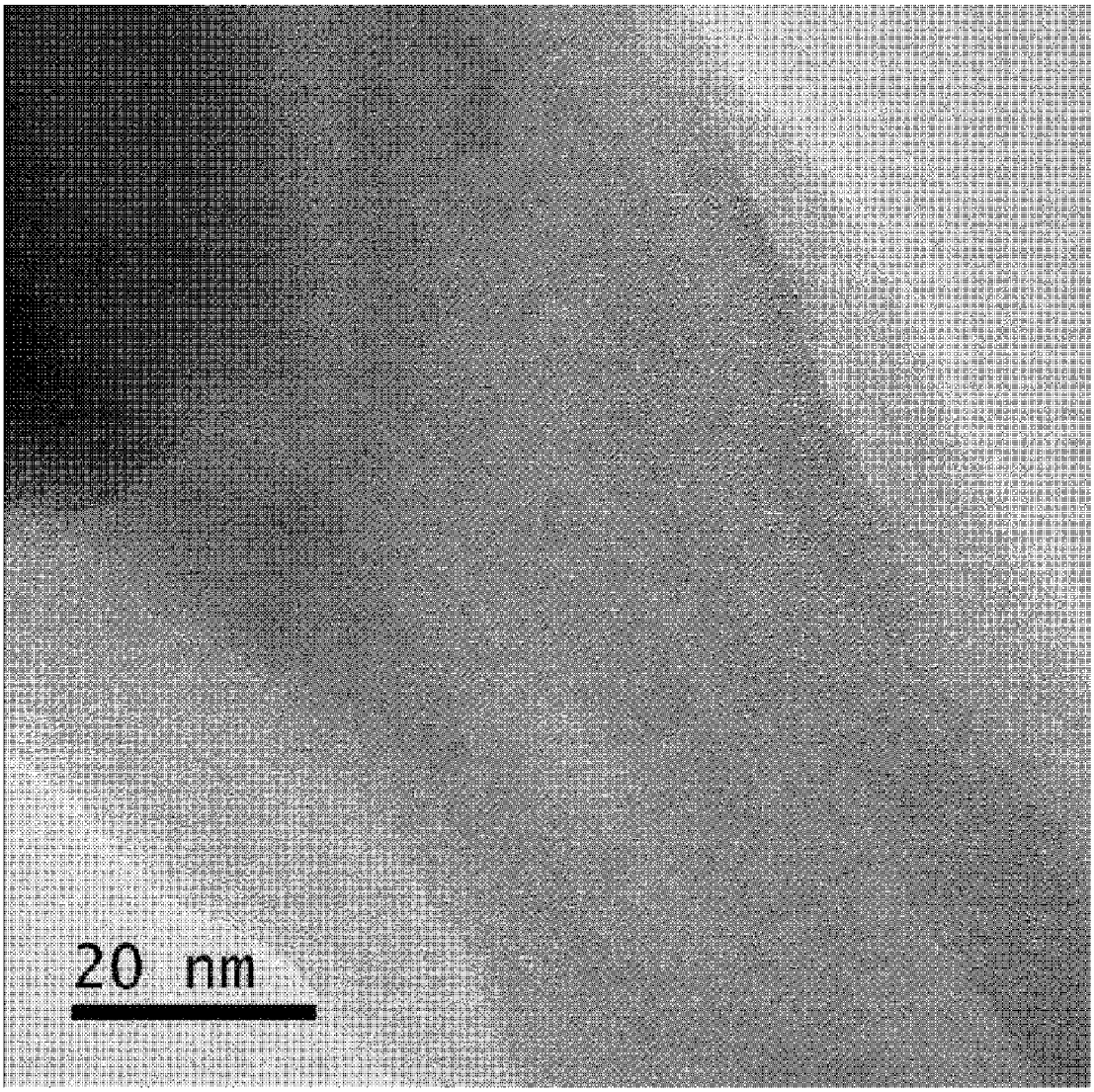

[FIG. 22]
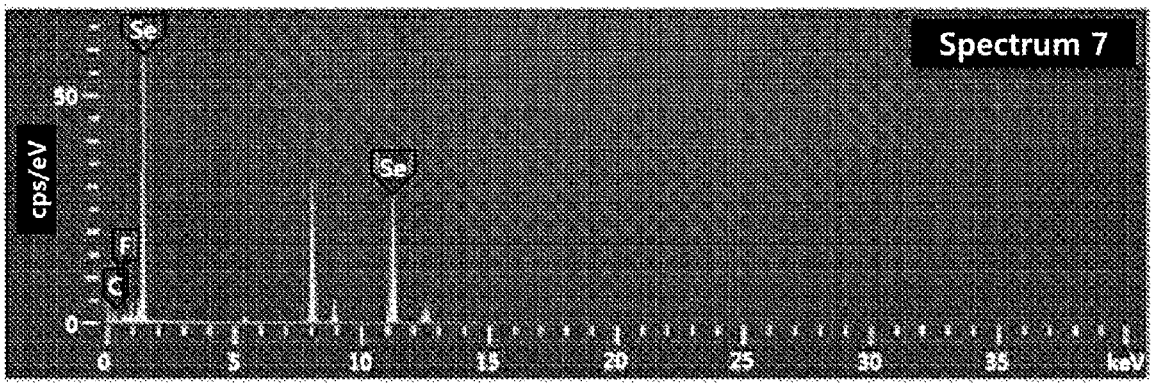
| Element | Line Type | Wt% |
|---|---|---|
| C | K series | 3.31 |
| F | K series | 1.56 |
| Se | L series | 95.13 |
| Total: | | 100.00 |

[FIG. 23]
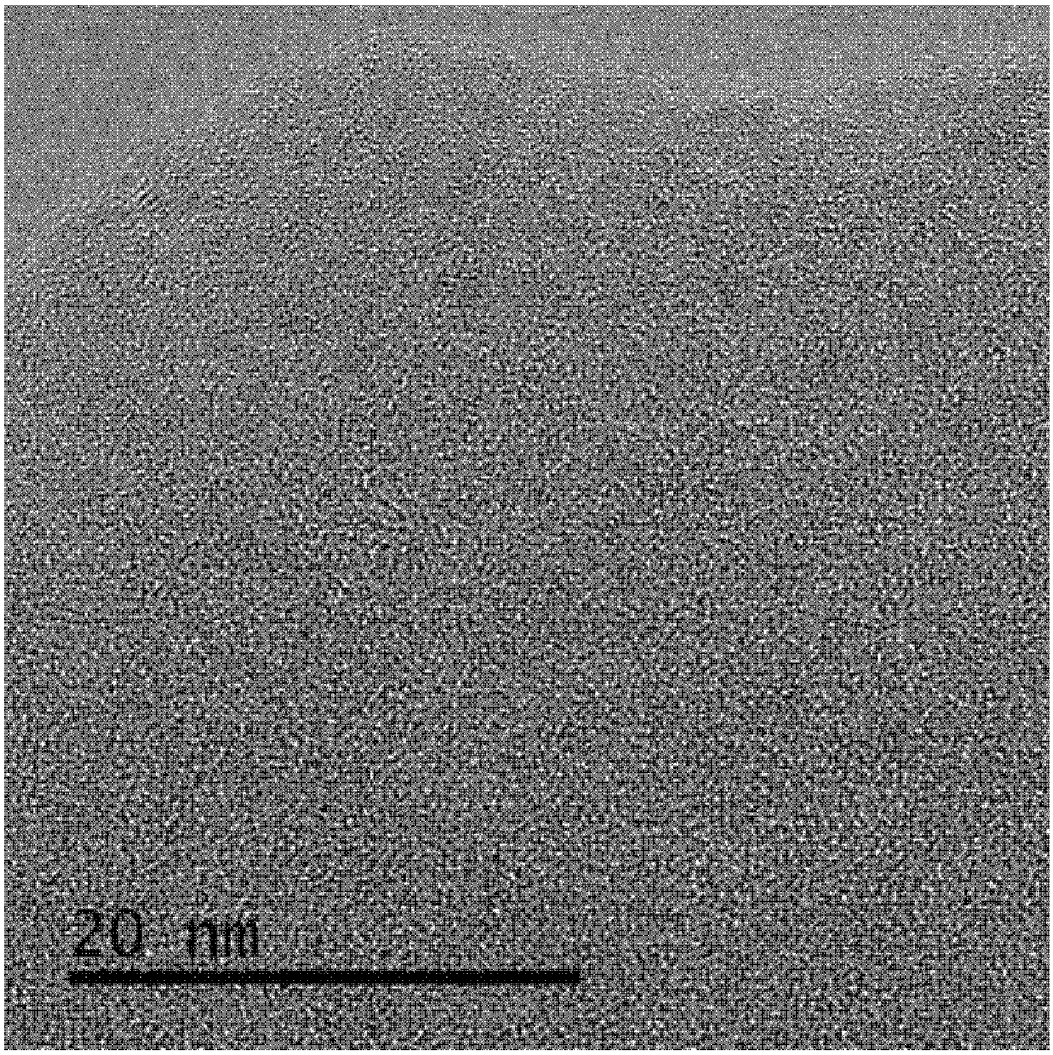

[FIG. 24]
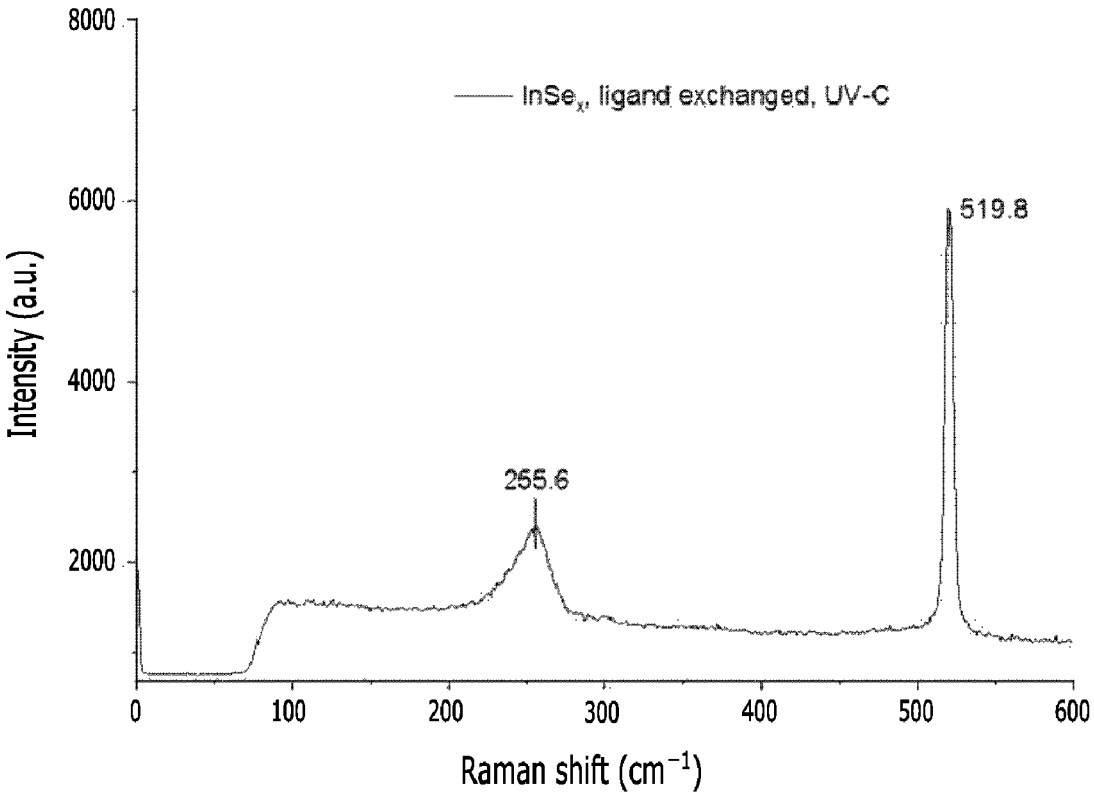

[FIG. 25]
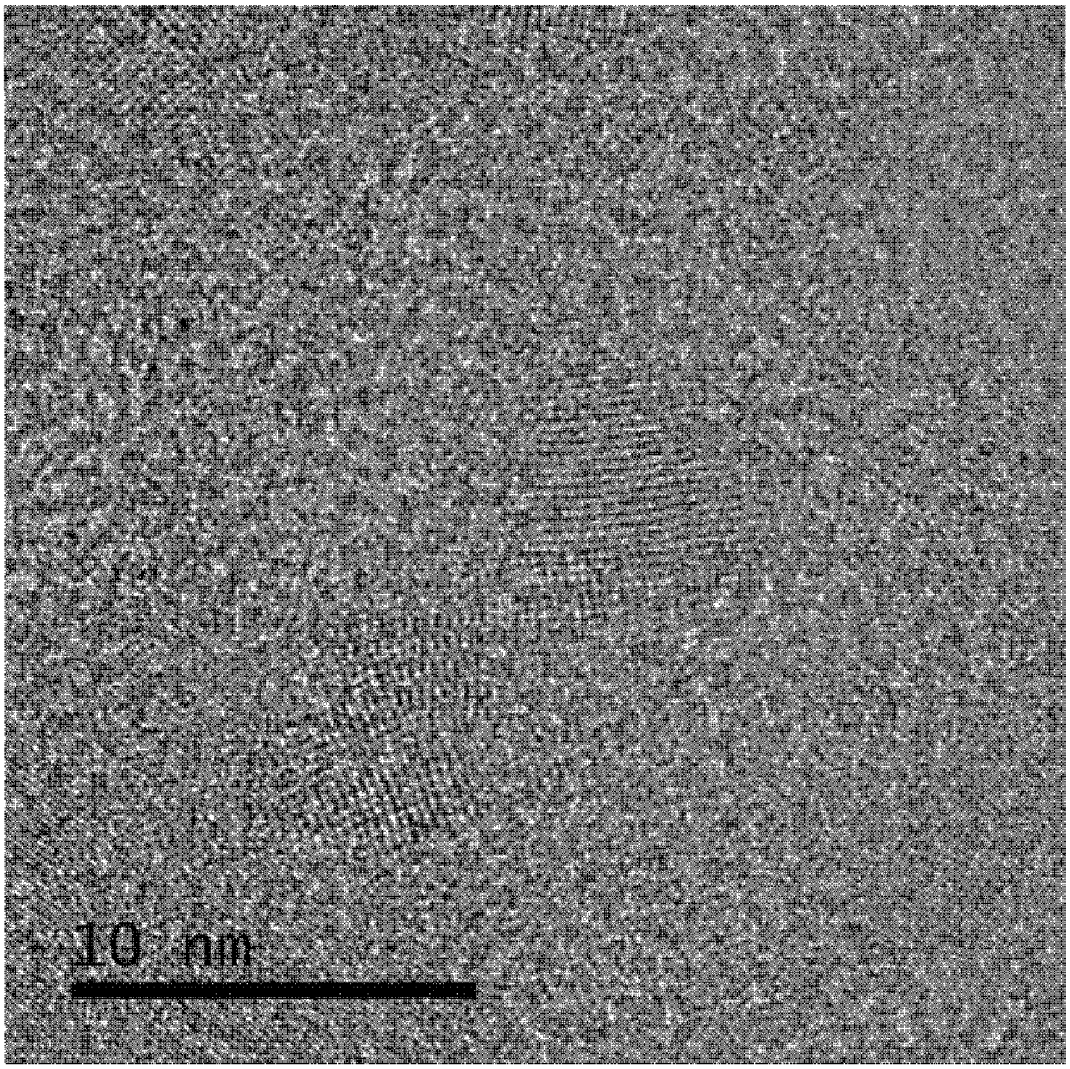

[FIG. 26]
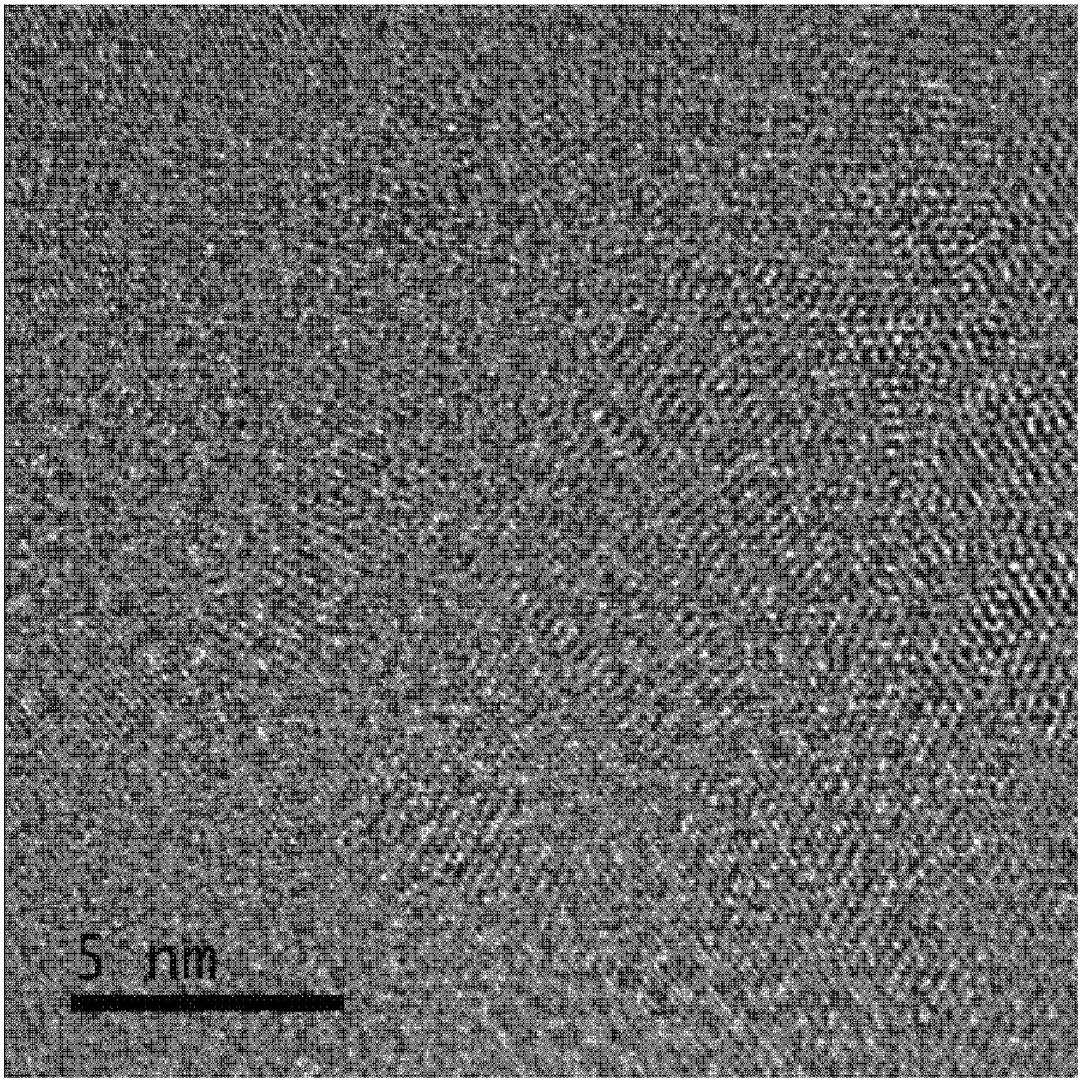

TRANSITION-METAL CHALCOGENIDE THIN FILM AND PREPARING METHOD OF THE SAME

CROSS-REFERENCE TO RELATED APPLICATIONS

This application claims the benefit under 35 USC 119(a) of Korean Patent Application No. 2019-0162621 filed on Dec. 9, 2019, in the Korean Intellectual Property Office, the entire disclosure of which is incorporated herein by reference for all purposes.

BACKGROUND

1. Field

The present disclosure relates to transition metal chalcogenide thin films and a manufacturing method thereof.

2. Description of Related Art

Transition metal chalcogenides have the advantage of having a band gap compared to graphene, i.e., an existing two-dimensional device. Particularly, transition metal chalcogenides have advantages that band gaps of transition metal chalcogenides are different depending on types of elements constituting transition metal chalcogenides, transition metal chalcogenides can be controlled from an indirect transition to a direct transition band depending on thickness, and a material itself of transition metal chalcogenides has a very thin thickness. Due to these advantages, transition metal chalcogenides can be variously applied to transistors, various integrated circuits, optoelectronic devices, gas sensors, wearable devices, etc.

As interest in flexible devices such as flexible displays, flexible sensors, etc. to which the aforementioned transition metal chalcogenides is applied has been increased, a method of transferring the transition metal chalcogenide thin films to a flexible substrate after manufacturing transition metal chalcogenide thin films on a high heat resistant substrate has been used. Plastic substrates have been used as the flexible substrate, but a transfer process has been essential since most of the plastic substrates are deformed at a temperature required for the manufacture of transition metal chalcogenide thin films. However, there have been problems that the transfer process results in unnecessary cracks or defects, and impurities remain to degrade the physical and electrical properties of the original thin film. Therefore, there is a high interest in a method of directly forming the transition metal chalcogenide thin films on the flexible substrate without performing the transfer process.

Korean registered patent No. 10-1623791 discloses a method of directly forming transition metal chalcogenide thin films on a substrate. However, a problem still remains that types of usable substrates are limited because high-temperature heat treatment is required.

Accordingly, there is a desire in research on a manufacturing method capable of directly forming high-quality transition metal chalcogenide thin films on a flexible substrate at low temperatures in the room temperature range.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a method of manufacturing transition metal chalcogenide thin films, includes the operations of: forming a transition metal chalcogenides precursor on a substrate; and irradiating light onto the transition metal chalcogenides precursor. The transition metal chalcogenides precursor includes an amine-based ligand.

The transition metal chalcogenides precursor may include a material represented by $LMX_{n+m}$, where the M is Mo, In, W, Hf, V, Sn, Re, Ta, Zn, Ga, Ge, Mn, As, Sb, Bi or Ti, the L is an amine-based ligand coordinated to the M, the X is S, Se or Te, the n is greater than 0 but less than or equal to 4, and m is greater than 0 but less than or equal to 12.

The operation of irradiating light may be performed under a temperature of 20° C. to 40° C., but the present disclosure is not limited thereto.

The substrate may be selected from the group consisting of a polymer including polyethylene naphthalate, polyphenyl sulfide, cyclic olefin copolymer, polyetherimide, polyarylate, polyimide, polyethylene terephthalate, nanocellulose, polydimethylsiloxane, polyamide, polycarbonate, polynorbornene, polyacrylate, polyvinyl alcohol, polyethersulfone, polystyrene, polypropylene, polyethylene, polybutylene terephthalate, polymethacrylate or combinations thereof, a ceramic including $SiO_2$, $Al_2O_3$, $ZrO_2$, $Si_3N_4$, SiC, AlN, $Fe_2O_3$, ZnO, BN or combinations thereof, and combinations thereof, but the present disclosure is not limited thereto.

The light may include light having a wavelength region of 180 nm to 500 nm, but the present disclosure is not limited thereto.

The amine-based ligand may be selected from the group consisting of $NH_4^+$, $N_2H_5^+$, $CH_3NH_3^+$, hydrazine, ethylenediamine, 2-aminoethanol, and combinations thereof, but the present disclosure is not limited thereto.

The operation of forming the transition metal chalcogenides precursor may include patterning the transition metal chalcogenides precursor to form the transition metal chalcogenides, but the present disclosure is not limited thereto.

The transition metal chalcogenides precursor may be formed by a method selected from the group consisting of spin coating, bar coating, inkjet printing, nozzle printing, spray coating, slot die coating, gravure printing, screen printing, electrohydrodynamic jet printing, electrospray, and combinations thereof, but the present disclosure is not limited thereto.

The operation of forming the transition metal chalcogenides precursor may be performed by applying a solution of the transition metal chalcogenides precursor onto the substrate, but the present disclosure is not limited thereto.

The solution may be selected from the group consisting of ethylenediamine, 2-aminoethanol, dimethyl sulfoxide, dimethylformamide, N-methyl-2-pyrrolidone, 1,2-ethanedithiol, ethylene glycol, ether, DMF, THF, HMPA, and combinations thereof, but the present disclosure is not limited thereto.

The transition metal chalcogenide thin films may include a material represented by:

$MX_n$, where, the M is Mo, In, W, Hf, V, Sn, Re, Ta, Zn, Ga, Ge, Mn, As, Sb, Bi or Ti, the X is S, Se or Te, and the n is greater than 0 but less than or equal to 4.

In chemical formula 2 of the transition metal chalcogenides, then may mean the number of chalcogen atoms bonded to one atom of a transition metal included in the transition metal chalcogenide thin films.

A second aspect of the present disclosure provides transition metal chalcogenide thin films manufactured by the method according to the first aspect of the present disclosure.

An integrated circuit, an optoelectronic device, a sensor, or a wearable device may include the transition metal chalcogenide thin film.

Other features and aspects will be apparent from the following detailed description, the drawings, and the claims.

BRIEF DESCRIPTION OF THE DRAWINGS

FIG. 1 is a flowchart showing a method of manufacturing transition metal chalcogenide thin films according to an embodiment of the present disclosure.

FIG. 2 is a conceptual diagram showing a method of manufacturing chalcogenide thin films according to an embodiment of the present disclosure.

FIG. 3 is a conceptual diagram showing a method of manufacturing chalcogenide thin films according to an embodiment of the present disclosure.

FIG. 4 is a graph showing a wavelength region of light used in a method of manufacturing transition metal chalcogenide thin films according to an example of the present disclosure.

FIG. 5 is a graph showing a wavelength region of light used in a method of manufacturing transition metal chalcogenide thin films according to an example of the present disclosure.

FIG. 6 is a graph showing a wavelength region of light used in a method of manufacturing transition metal chalcogenide thin films according to an example of the present disclosure.

FIG. 7 is a High Resolution-Transmission Electron Microscope (HR-TEM) image of a $MoS_2$ thin film manufactured according to a method of manufacturing transition metal chalcogenide thin films according to Example 1 of the present disclosure.

FIG. 8 is Raman spectra of a $MoS_2$ precursor and a $MoS_2$ thin film manufactured according to a method of manufacturing transition metal chalcogenide thin films according to Example 1 of the present disclosure.

FIG. 9 is an HR-TEM image of a $MoS_2$ thin film manufactured according to a method of manufacturing transition metal chalcogenide thin films according to Example 2 of the present disclosure.

FIG. 10 is a Raman spectrum of a $MoS_2$ thin film manufactured according to a method of manufacturing transition metal chalcogenide thin films according to Example 2 of the present disclosure.

FIG. 11 is an HR-TEM image of an $SnS_x$ thin film manufactured according to a method of manufacturing transition metal chalcogenide thin films according to Example 3 of the present disclosure.

FIG. 12 is a Raman spectrum of an $SnS_x$ thin film manufactured according to a method of manufacturing transition metal chalcogenide thin films according to Example 3 of the present disclosure.

FIG. 13 is an HR-TEM image of an $SnS_x$ thin film manufactured according to a method of manufacturing transition metal chalcogenide thin films according to Example 4 of the present disclosure.

FIG. 14 is a Raman spectrum of an $SnS_x$ thin film manufactured according to a method of manufacturing transition metal chalcogenide thin films according to Example 4 of the present disclosure.

FIG. 15 is an HR-TEM image of a $SnSe_x$ thin film manufactured according to a method of manufacturing transition metal chalcogenide thin films according to Example 5 of the present disclosure.

FIG. 16 is a Raman spectrum of a $SnSe_x$ thin film manufactured according to a method of manufacturing transition metal chalcogenide thin films according to Example 5 of the present disclosure.

FIG. 17 is an HR-TEM image of an $InSe_x$ thin film manufactured according to a method of manufacturing transition metal chalcogenide thin films according to Example 6 of the present disclosure.

FIG. 18 is an electron diffraction pattern for an HR-TEM image area of FIG. 17.

FIG. 19 is an Energy-dispersive X-ray spectroscopy (EDS) spectrum for the HR-TEM image area of FIG. 17, and an elemental composition obtained therethrough.

FIG. 20 is a Raman spectrum of an $InSe_x$ thin film manufactured according to a method of manufacturing transition metal chalcogenide thin films according to Example 6 of the present disclosure.

FIG. 21 is an HR-TEM image of an $InSe_x$ thin film manufactured according to a method of manufacturing transition metal chalcogenide thin films according to Example 7 of the present disclosure.

FIG. 22 is an EDS spectrum for an HR-TEM image area of FIG. 21, and an elemental composition obtained therethrough.

FIG. 23 is an HR-TEM image of an $InSe_x$ thin film manufactured according to a method of manufacturing transition metal chalcogenide thin films according to Example 8 of the present disclosure.

FIG. 24 is a Raman spectrum of an $InSe_x$ thin film manufactured according to a method of manufacturing transition metal chalcogenide thin films according to Example 8 of the present disclosure.

FIG. 25 is an HR-TEM image of an $SnS_x$ thin film manufactured according to a method of manufacturing transition metal chalcogenide thin films according to Comparative Example 1 of the present disclosure.

FIG. 26 is a high magnification HR-TEM image of an $SnS_x$ thin film manufactured according to a method of manufacturing transition metal chalcogenide thin films according to Comparative Example 1 of the present disclosure.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known after understanding of the disclosure of this application may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

When unique manufacture and material allowable errors of numerical values are suggested to mentioned meanings of terms of degrees used in the present disclosure such as "about", "substantially", etc., the terms of degrees are used as the numerical values or as a meaning near the numerical values, and the terms of degrees are used to prevent that an unscrupulous infringer unfairly uses a disclosure content in which exact or absolute numerical values are mentioned to help understanding of the present disclosure. Further, in the whole present specification, "an operation doing ~" or "an operation of ~" does not mean "an operation for ~".

In the whole present specification, a term of "a combination thereof" included in a Markush type expression, which means a mixture or combination of one or more selected from the group consisting of elements described in the Markush type expression, and means including one or more selected from the group consisting of the elements.

Hereinafter, transition metal chalcogenide thin films according to the present disclosure will be described in detail with reference to embodiments, examples and drawings. However, the present disclosure is not limited to such embodiments, examples and drawings.

As a technical means for achieving the aforementioned technical object, a first aspect of the present disclosure provides a method of manufacturing transition metal chalcogenide thin films, the manufacturing method including the operations of: forming a transition metal chalcogenides precursor on a substrate; and irradiating light onto the transition metal chalcogenides precursor, in which the transition metal chalcogenides precursor includes an amine-based ligand.

A method of manufacturing chalcogenide thin films according to the present disclosure enables the formation of transition metal chalcogenide thin films in a room temperature range, for example, in a low temperatures range of 20° C. to 40° C. Since deformation of a plastic flexible substrate does not occur in such a temperature range, the transition metal chalcogenide thin films may be directly formed on the plastic flexible substrate. Accordingly, a transfer process which may leave cracks, residues or the like is also unnecessary.

As a method of manufacturing transition metal chalcogenide thin films according to the present disclosure enables a process operation to be carried out at low temperatures as described above, various substrates may be selected and used depending on the purpose regardless of thermal properties such as thermal expansion coefficient, heat resistance, etc. of the substrate.

Especially, flexible devices have recently been in the spotlight, and the use of plastic flexible substrates is essential to this end. However, polymer materials used in general plastic flexible substrates have required low processing temperatures due to high thermal expansion coefficients. Since a method of manufacturing transition metal chalcogenide thin films according to the present disclosure enables the transition metal chalcogenide thin films to be formed even at low temperatures, the transition metal chalcogenide thin films may be directly formed on the substrate requiring low processing temperatures.

A method of manufacturing transition metal chalcogenide thin films according to the present disclosure has excellent reactivity to light by using a precursor including an amine-based ligand. Further, a method of manufacturing transition metal chalcogenide thin films according to the present disclosure may enable very high crystallinity to be implemented compared to the level normally expected at low temperatures by the transition metal chalcogenide thin films by facilitating separation of the ligand due to irradiation of light. Further, a method of manufacturing transition metal chalcogenide thin films according to the present disclosure facilitates solubilization of the precursor and uniform application of the precursor on the substrate, making it easy to manufacture the transition metal chalcogenide thin films through large-area formation and continuous process.

FIG. 1 is a flowchart showing a method of manufacturing transition metal chalcogenide thin films according to an embodiment of the present disclosure.

First, a transition metal chalcogenides precursor is formed on a substrate in order to manufacture transition metal chalcogenide thin films (S100).

According to an embodiment of the present disclosure, the transition metal chalcogenides precursor may be formed by a method selected from the group consisting of spin coating, bar coating, inkjet printing, nozzle printing, spray coating, slot die coating, gravure printing, screen printing, electrohydrodynamic jet printing, electrospray, and combinations thereof, but the present disclosure is not limited thereto.

According to an embodiment of the present disclosure, the operation of forming the transition metal chalcogenides precursor may include patterning the transition metal chalcogenides precursor to form the transition metal chalcogenides, but the present disclosure is not limited thereto.

FIG. 2 is a conceptual diagram showing a method of manufacturing chalcogenide thin films according to an embodiment of the present disclosure.

FIG. 3 is a conceptual diagram showing a method of manufacturing chalcogenide thin films according to an embodiment of the present disclosure.

For example, when forming the precursor on the substrate by spin coating or bar coating, the precursor may be uniformly formed on the substrate. Although it will be described later, an additional patterning operation may be carried out in a subsequent process if necessary. On the other hand, when carrying out an inkjet printing operation, the transition metal chalcogenides precursor is formed on the substrate, and patterns may be formed on the transition metal chalcogenides precursor at the same time. Accordingly, a finally patterned transition metal chalcogenide thin films may be obtained.

According to an embodiment of the present disclosure, the transition metal chalcogenides precursor may include a material represented by the following chemical formula 1, but the present disclosure is not limited thereto:

$$LMX_{n+m}, \quad \text{[Chemical Formula 1]}$$

where, the M is Mo, In, W, Hf, V, Sn, Re, Ta, Zn, Ga, Ge, Mn, As, Sb, Bi or Ti, the L is an amine-based ligand coordinated to the M, the X is S, Se or Te, the n is more than 0 to not more than 4, and the m is more than 0 to not more than 12.

The n in chemical formula 1 of the transition metal chalcogenides precursor may mean the number of chalcogen atoms bonded to one atom of a transition metal included in transition metal chalcogenide thin films manufactured by the chalcogenides precursor, and the n+m may mean the number of chalcogen atoms bonded to one atom of the transition metal, which are capable of stabilizing the transition metal chalcogenides precursor.

According to an embodiment of the present disclosure, the transition metal chalcogenide thin films may include a material represented by the following chemical formula 2, but the present disclosure is not limited thereto:

$$MX_n, \quad \text{[Chemical Formula 2]}$$

where, the M is Mo, In, W, Hf, V, Sn, Re, Ta, Zn, Ga, Ge, Mn, As, Sb, Bi or Ti, the X is S, Se or Te, and the n is more than 0 to not more than 4.

The transition metal chalcogenides precursor may be formed in a form in which an amine-based ligand and an additional chalcogen element are bonded onto a transition metal chalcogenides. The transition metal chalcogenides precursor may have a higher proportion of the chalcogen element to the transition metal compared to the transition metal chalcogenides that is synthesized.

Although the transition metal chalcogenides precursor and/or the transition metal chalcogenide thin films may include one type of transition metal element (M) and chalcogen element (X) respectively, it is also possible that the transition metal chalcogenides precursor and/or the transition metal chalcogenide thin films may include two or more types of transition metal element (M) and chalcogen element (X) respectively.

According to an embodiment of the present disclosure, the amine-based ligand may be selected from the group consisting of $NH_4^+$, $N_2H_5^+$, $CH_3NH_3^+$, hydrazine, ethylenediamine, 2-aminoethanol, and combinations thereof, but the present disclosure is not limited thereto.

The ligand may be one type of amine-based ligand, or a combination of two or more types of ligand, including the one type of amine-based ligand.

Transition metal chalcogenide thin films manufactured according to the method of manufacturing the present disclosure depending on the types and molecular weights of the ligand may have different uniformities and crystallinities.

As the molecular weight of the amine-based ligand contained in transition metal chalcogenide precursor according to the present disclosure increases, a wavelength required for crystallization of the transition metal chalcogenide thin films may be shortened. High crystallinity means that a crystal close to a single crystal is formed. For example, light with a shorter wavelength may be required to obtain a high crystalline transition metal chalcogenide thin films when using $CH_3NH_3^+$ or $N_2H_5^+$ as the amine-based ligand compared to when using $NH_4^+$ as the amine-based ligand.

A method of manufacturing transition metal chalcogenide thin films according to the present disclosure has excellent reactivity to light by using a precursor including an amine-based ligand. Further, a method of manufacturing transition metal chalcogenide thin films according to the present disclosure may enable very high crystallinity to be implemented compared to the level normally expected at low temperatures by the transition metal chalcogenide thin films by facilitating separation of the ligand due to irradiation of light. Further, a method of manufacturing transition metal chalcogenide thin films according to the present disclosure facilitates solubilization of the precursor and uniform application of the precursor on the substrate, making it easy to manufacture the transition metal chalcogenide thin films through large-area formation and continuous process.

According to an embodiment of the present disclosure, the operation of forming the transition metal chalcogenides precursor may be performed by applying a solution of the transition metal chalcogenides precursor onto the substrate, but the present disclosure is not limited thereto.

According to an embodiment of the present disclosure, the solution may be selected from the group consisting of ethylenediamine, 2-aminoethanol, dimethyl sulfoxide, dimethylformamide, N-methyl-2-pyrrolidone, 1,2-ethanedithiol, ethylene glycol, ether, DMF, THF, HMPA, and combinations thereof, but the present disclosure is not limited thereto.

The solution may be replaced with a ligand coordinated on the transition metal chalcogenides precursor by containing a material that may act as a ligand for the transition metal chalcogenides precursor.

The transition metal chalcogenides precursor may include a transition metal chalcogenides precursor obtained by dissolving a commercially available transition metal chalcogenides precursor in a solvent, or a transition metal chalcogenides precursor formed in the form of a solution.

After this, light is irradiated onto a transition metal chalcogenides precursor (S200).

According to an embodiment of the present disclosure, the operation of irradiating light may be performed under a temperature of 20° C. to 40° C., but the present disclosure is not limited thereto.

A method of manufacturing chalcogenide thin films according to the present disclosure enables transition metal chalcogenide thin films to be formed in the foregoing low-temperature range. As deformation of a plastic flexible substrate does not occur in such a temperature range, the transition metal chalcogenide thin films may be directly formed on the plastic flexible substrate. Therefore, a transfer process that may leave cracks, residues, and the like is also unnecessary.

According to an embodiment of the present disclosure, the substrate may be selected from the group consisting of a polymer including polyethylene naphthalate, polyphenyl sulfide, cyclic olefin copolymer, polyetherimide, polyarylate, polyimide, polyethylene terephthalate, nanocellulose, polydimethylsiloxane, polyamide, polycarbonate, polynorbornene, polyacrylate, polyvinyl alcohol, polyethersulfone, polystyrene, polypropylene, polyethylene, polybutylene terephthalate, polymethacrylate or combinations thereof, a ceramic including $SiO_2$, $Al_2O_3$, $ZrO_2$, $Si_3N_4$, SiC, AlN, $Fe_2O_3$, ZnO, BN or combinations thereof, and combinations thereof, but the present disclosure is not limited thereto.

As a method of manufacturing transition metal chalcogenide thin films according to the present disclosure enables a process operation to be carried out at low temperatures as described above, various substrates may be selected and used depending on the purpose regardless of thermal properties such as thermal expansion coefficient, heat resistance, etc. of the substrate.

Especially, flexible devices have recently been in the spotlight, and the use of plastic flexible substrates is essential to this end. However, polymer materials used in general plastic flexible substrates have required low processing temperatures since the polymer materials are easily deformed at high temperatures due to high thermal expansion coefficients. Since a method of manufacturing transition metal chalcogenide thin films according to the present disclosure enables the transition metal chalcogenide thin films to be formed even at low temperatures, the transition metal chalcogenide thin films may be directly formed on the substrate requiring low processing temperatures. Therefore, the transition metal chalcogenide thin films may be directly formed on the flexible substrates without performing the transfer process.

A method of manufacturing transition metal chalcogenide thin films according to the present disclosure may include irradiating the light onto the transition metal chalcogenides precursor to decompose a portion of the transition metal chalcogenides precursor formed on the substrate so that the transition metal chalcogenide thin films is formed on the substrate.

According to an embodiment of the present disclosure, the light may include light having a wavelength region of 180 nm to 500 nm, but the present disclosure is not limited thereto. The light may include light having a wavelength region of 180 nm to 500 nm.

The light having the wavelength region includes ultraviolet rays (UV-A, UV-B, and UV-C) and visible lights having short wavelengths (violet, blue and green regions).

FIGS. 4 to 6 are graphs showing wavelength regions of lights used in a method of manufacturing transition metal chalcogenide thin films according to an example of the present disclosure.

Referring to FIGS. 4 to 6, it can be confirmed that a plurality of lights having different wavelengths during irradiation of the lights may be simultaneously irradiated.

In a method of manufacturing transition metal chalcogenide thin films according to the present disclosure, transition metal chalcogenide thin films manufactured according to wavelengths of lights irradiated may have different uniformities and crystallinities.

Transition metal chalcogenide thin films, according to the present disclosure, may have different optimal light wavelengths required for crystallization depending on a metal element forming the transition metal chalcogenide thin films. Transition metal chalcogenide thin films, including a metal element having a low melting point, may have a relatively long wavelength required to secure high crystallinity. For example, a highly crystalline transition metal chalcogenide thin films may be obtained in a relatively long wavelength region when using In as the metal element compared to when using Mo as the metal element.

A method of manufacturing transition metal chalcogenide thin films according to the present disclosure may adjust the ratio of chalcogen element to the metal element. For example, a method of manufacturing transition metal chalcogenide thin films according to the present disclosure may manufacture transition metal chalcogenide thin films having a high ratio of the chalcogen element to the metal element by irradiating light having a relatively long wavelength.

A method of manufacturing transition metal chalcogenide thin films according to the present disclosure may manufacture transition metal chalcogenide thin films with different composition ratios depending on the irradiation time of light. For example, when irradiating the light for a long time, transition metal chalcogenide thin films with more excellent crystallinity and a large domain size may be obtained.

Further, the irradiation time of the light for obtaining transition metal chalcogenide thin films with excellent crystallinity may vary depending on the wavelength of the light. For example, when irradiating light with a short wavelength (with large energy), the irradiation time of light for obtaining transition metal chalcogenide thin films with excellent crystallinity may be reduced.

In addition, a method of manufacturing transition metal chalcogenide thin films according to the present disclosure, when irradiating the light, may form a pattern using a photomask.

A second aspect of the present disclosure provides the transition metal chalcogenide thin films manufactured by the method according to the first aspect of the present disclosure.

The transition metal chalcogenide thin films are directly formed on a flexible substrate so that the transition metal chalcogenide thin films may be used in a flexible device without performing a separate transfer process.

Hereinafter, the present disclosure will be described in more detail through Examples, but the following Examples are only for the purpose of describing the present disclosure, and the scope of the present disclosure is not limited thereto.

EXAMPLE 1

Manufacturing of a $MoS_2$ Thin Film

A transition metal chalcogenides precursor solution was formed by dissolving 11.0 mg of commercially available $(NH_4)_2MoS_4$ in 1.00 ml of dimethylformamide (DMF). After spin-coating the solution on a $SiO_2$/Si substrate in a low-humidity environment, the solution spin-coated on the substrate was dried to form a precursor layer on the substrate. Thereafter, $MoS_2$ transition metal chalcogenide thin films were finally formed on the substrate by irradiating UV-C onto the precursor layer using a Sankyo UV-C G8T5 8 W lamp at a temperature of about 25° C., thereby decomposing a portion of the precursor.

FIG. 7 is an HR-TEM image of a $MoS_2$ thin film manufactured according to a method of manufacturing transition metal chalcogenide thin films according to Example 1 of the present disclosure.

Referring to FIG. 7, it can be confirmed that transition metal chalcogenide thin films with excellent crystallinity and large-sized crystal domain is manufactured.

FIG. 8 is Raman spectra of a $MoS_2$ precursor and a $MoS_2$ thin film manufactured according to a method of manufacturing transition metal chalcogenide thin films according to Example 1 of the present disclosure.

Referring to FIG. 8, it can be confirmed that, as the precursor is chemically changed by the irradiation of UV-C at room temperature, transition metal chalcogenides may be formed.

EXAMPLE 2

Manufacturing of a $MoS_2$ Thin Film

A transition metal chalcogenides precursor solution was formed by dissolving 11.0 mg of commercially available $(NH_4)_2MoS_4$ in 1.00 ml of dimethylformamide (DMF). After spin-coating the solution on a $SiO_2$/Si substrate in a low-humidity environment, the solution spin-coated on the substrate was dried to form a precursor layer on the substrate. Thereafter, $MoS_2$ transition metal chalcogenide thin films were finally formed on the substrate by irradiating UV-A onto the precursor layer using a Hitachi F8T5 8 W lamp at a temperature of about 25° C., thereby decomposing a portion of the precursor.

FIG. 9 is an HR-TEM image of a $MoS_2$ thin film manufactured according to a method of manufacturing transition metal chalcogenide thin films according to Example 2 of the present disclosure.

Referring to FIG. 9, it can be confirmed that transition metal chalcogenide thin films with excellent crystallinity and large-sized crystal domain are manufactured.

FIG. 10 is a Raman spectrum of a $MoS_2$ thin film manufactured according to a method of manufacturing transition metal chalcogenide thin films according to Example 2 of the present disclosure.

Referring to FIG. 10, it can be confirmed that, as the precursor is chemically changed even by the irradiation of UV-A at room temperature, transition metal chalcogenides may be formed.

Referring to Examples 1 and 2, it can be confirmed that UV-C and UV-A may exhibit the same effect when forming transition metal chalcogenides using the precursor. Hereby, it can be confirmed that light decomposing the precursor to form a specific transition metal chalcogenides may not be a single wavelength.

EXAMPLE 3

Manufacturing of an $SnS_x$ Thin Film

A transition metal chalcogenides precursor solution was prepared by dissolving 19.5 mg of commercially available tin (II) sulfide (SnS) and 32.6 mg of commercially available sulfur (S) in 1.50 ml of anhydrous hydrazine prepared by dehydration of hydrazine hydrate. After spin-coating the solution on a $SiO_2$/Si substrate in a low-humidity environment, the solution spin-coated on the substrate was dried to form a precursor layer on the substrate. Thereafter, transition metal chalcogenide thin films were finally formed on the substrate by irradiating UV-C onto the precursor layer at a distance of 20 cm using a Sankyo UV-C G8T5 8 W lamp at a temperature of about 25° C. for one hour, thereby decomposing a portion of the precursor.

FIG. 11 is an HR-TEM image of the thin film manufactured according to a method of manufacturing transition metal chalcogenide thin films according to Example 3 of the present disclosure.

Referring to FIG. 11, it can be confirmed that a transition metal chalcogenides crystal is being formed.

FIG. 12 is a Raman spectrum of an $SnS_x$ thin film manufactured according to a method of manufacturing transition metal chalcogenide thin films according to Example 3 of the present disclosure.

Referring to FIG. 12, it can be confirmed that the formed crystal is $SnS_2$.

EXAMPLE 4

Manufacturing of an $SnS_x$ Thin Film

An $SnS_x$ thin film was manufactured in the same manner as Example 3 except that UV-C was irradiated for 12 hours, i.e., a long time compared to Example 3.

FIG. 13 is an HR-TEM image of an $SnS_x$ thin film manufactured according to a method of manufacturing transition metal chalcogenide thin films according to Example 4 of the present disclosure.

Referring to FIG. 13, it can be confirmed that transition metal chalcogenide thin films having excellent crystallinity and large-sized crystal domain was manufactured, and a more excellent crystal was obtained compared to FIG. 11 according to Example 3.

FIG. 14 is a Raman spectrum of an $SnS_x$ thin film manufactured according to a method of manufacturing transition metal chalcogenide thin films according to Example 4 of the present disclosure.

Referring to FIG. 14, it can be confirmed that a thin film finally formed according to Example 4 is mainly included of SnS differently from Example 3. Further, when comparing FIG. 14 with FIG. 12 of Example 3, it can be confirmed that material with a different composition ratio may be obtained depending on irradiation time when using light with the same wavelength as the same precursor.

EXAMPLE 5

Manufacturing of a $SnSe_x$ Thin Film

A transition metal chalcogenides precursor solution was prepared by dissolving 24.7 mg of commercially available SnSe and 29.6 mg of commercially available Se in 1.50 ml of anhydrous hydrazine prepared by dehydration of hydrazine hydrate. After spin-coating the solution on a $SiO_2$/Si substrate in a low-humidity environment, the solution spin-coated on the substrate was dried to form a precursor layer on the substrate. Thereafter, a $SnSe_x$ ($1 \leq x \leq 3$) transition metal chalcogenide thin films was finally formed on the substrate by irradiating UV-C onto the precursor layer using a Sankyo UV-C G8T5 8 W lamp at a temperature of about 25° C., thereby decomposing a portion of the precursor.

FIG. 15 is an HR-TEM image of a $SnSe_x$ thin film manufactured according to a method of manufacturing transition metal chalcogenide thin films according to Example 5 of the present disclosure.

Referring to FIG. 15, it can be confirmed that transition metal chalcogenide thin films with excellent crystallinity and large-sized crystal domain are manufactured.

FIG. 16 is a Raman spectrum of a $SnSe_x$ thin film manufactured according to a method of manufacturing transition metal chalcogenide thin films according to Example 5 of the present disclosure.

Referring to FIG. 16, it can be confirmed that a thin film formed according to Example 5 is mainly included in $SnSe_2$.

EXAMPLE 6

Manufacturing of an $InSe_x$ Thin Film

A transition metal chalcogenides precursor solution was prepared by dissolving 57.5 mg of commercially available $In_2Se_3$ and 12.7 mg of commercially available Se in 1.50 ml of anhydrous hydrazine prepared by dehydration of hydrazine hydrate. After spin-coating the solution on a $SiO_2$/Si substrate in a low-humidity environment, the solution spin-coated on the substrate was dried to form a precursor layer on the substrate. Thereafter, an $InSe_x$ ($1 \leq x \leq 3$) transition metal chalcogenide thin films was finally formed on the substrate by irradiating UV-A onto the precursor layer using a Hitachi F8T5 8 W lamp at a temperature of about 25° C., thereby decomposing a portion of the precursor.

FIG. 17 is an HR-TEM image of an $InSe_x$ thin film manufactured according to a method of manufacturing transition metal chalcogenide thin films according to Example 6 of the present disclosure.

Referring to FIG. 17, it can be confirmed that transition metal chalcogenide thin films with excellent crystallinity is manufactured.

FIG. 18 is an electron diffraction pattern for an HR-TEM image area of FIG. 17.

Referring to FIG. 18, it can be confirmed that crystal domains with a single crystal structure are mainly oriented in a random direction.

FIG. 19 is an EDS spectrum for the HR-TEM image area of FIG. 17, and an elemental composition obtained therethrough.

Referring to FIG. 19, it can be confirmed that elements composing the thin film manufactured according to a method of manufacturing transition metal chalcogenide thin films according to Example 6 of the present disclosure are indium (In) and selenium (Se).

FIG. 20 is a Raman spectrum of an $InSe_x$ thin film manufactured according to a method of manufacturing transition metal chalcogenide thin films according to Example 6 of the present disclosure.

Referring to FIG. 20, it can be confirmed that the formed thin film is mainly included in $In_2Se_3$.

EXAMPLE 7

Manufacturing of an $InSe_x$ Thin Film

A transition metal chalcogenides precursor solution was prepared by dissolving 57.5 mg of commercially available $In_2Se_3$ and 12.7 mg of commercially available Se in 1.50 ml of anhydrous hydrazine prepared by dehydration of hydrazine hydrate. After spin-coating the solution on a $SiO_2$/Si substrate in a low-humidity environment, the solution spin-coated on the substrate was dried to form a precursor layer on the substrate. Thereafter, an $InSe_x$ ($1 \leq x \leq 3$) transition metal chalcogenide thin films was finally formed on the substrate by irradiating UV-C onto the precursor layer using a Sankyo UV-C G8T5 8 W lamp at a temperature of about 25° C., thereby decomposing a portion of the precursor.

FIG. 21 is an HR-TEM image of a portion of an $InSe_x$ thin film manufactured according to a method of manufacturing transition metal chalcogenide thin films according to Example 7 of the present disclosure.

FIG. 22 is an EDS spectrum for an HR-TEM image area of FIG. 21, and an elemental composition obtained therethrough.

Referring to FIG. 22, it can be confirmed that a main element composing the thin film of the HR-TEM image area of FIG. 21 is selenium (Se), and it can be confirmed that an amorphous selenium (Se) film is formed without forming $InSe_x$ on some areas when irradiating UV-C therethrough.

Referring to Examples 6 and 7, it can be seen that, even though the same precursors are used, wavelengths of light irradiated onto the precursors affect uniformity and crystallinity of the thin films.

EXAMPLE 8

Manufacturing of an $InSe_x$ Thin Film

A solution was prepared by dissolving 59.2 mg of commercially available $In_2Se_3$ and 10.1 mg of commercially available Se in 1.50 ml of anhydrous hydrazine prepared by dehydration of hydrazine hydrate. After adding 600 μL of 2-aminoethanol/DMSO with a 3:5 v/v ratio to 150 μL of the solution to obtain a mixed solution, the mixed solution was heated until a precipitate was formed at 160° C. Thereafter, a centrifugal process was performed to separate the precipitate. A transition metal chalcogenides precursor solution was prepared by adding 150 μL of a 2-aminoethanol/DMSO solvent with a 3:5 v/v ratio to the separated precipitate.

After spin-coating the solution on a $SiO_2$/Si substrate in a low-humidity environment, the solution spin-coated on the substrate was dried to form a precursor layer on the substrate. Thereafter, an $InSe_x$ ($1 \leq x \leq 3$) transition metal chalcogenide thin films was finally formed on the substrate by irradiating UV-C onto the precursor layer using a Sankyo UV-C G8T5 8 W lamp, thereby decomposing a portion of the precursor.

FIG. 23 is an HR-TEM image of an $InSe_x$ thin film manufactured according to a method of manufacturing transition metal chalcogenide thin films according to Example 8 of the present disclosure.

Referring to FIG. 23, it can be confirmed that transition metal chalcogenide thin films manufactured using a transition metal chalcogenides precursor, including a ligand with a large molecular weight being formed in a uniform amorphous form.

FIG. 24 is a Raman spectrum of an $InSe_x$ thin film manufactured according to a method of manufacturing transition metal chalcogenide thin films according to Example 8 of the present disclosure.

Referring to FIG. 24, it can be confirmed that transition metal chalcogenide thin films manufactured using a transition metal chalcogenides precursor including a ligand with a large molecular weight is formed in the form of amorphous $In_2Se_3$.

Referring to Examples 7 and 8, it can be seen that, when using light with the same wavelength as the same precursors, the size and type of ligands coupled to the precursors affect uniformity and crystallinity of the thin films.

COMPARATIVE EXAMPLE 1

Manufacturing of an $SnS_x$ Thin Film

A transition metal chalcogenides precursor solution was prepared by dissolving 19.5 mg of commercially available SnS and 32.6 mg of commercially available sulfur (S) in 1.50 ml of anhydrous hydrazine prepared by dehydration of hydrazine hydrate. After spin-coating the solution on a $SiO_2$/Si substrate in a low-humidity environment, the solution spin-coated on the substrate was dried to form a precursor layer on the substrate. Thereafter, an $SnS_x$ ($1 \leq x \leq 3$) transition metal chalcogenide thin films was finally formed on the substrate by heat-treating the precursor layer to a temperature of 300° C.

FIG. 25 is an HR-TEM image of an $SnS_x$ thin film manufactured according to a method of manufacturing transition metal chalcogenide thin films according to Comparative Example 1 of the present disclosure.

FIG. 26 is an HR-TEM image having a high magnification compared to FIG. 25 of an $SnS_x$ thin film manufactured according to a method of manufacturing transition metal chalcogenide thin films according to Comparative Example 1 of the present disclosure.

Referring to FIGS. 25 and 26, it can be confirmed that a thin film with a small domain size is obtained when forming transition metal chalcogenide thin films by performing a heat treatment process at high temperatures instead of performing an ultraviolet light-irradiating process at room temperature as in the manufacturing method according to the present disclosure. Therefore, it can be seen that transition metal chalcogenide thin films with more excellent crystallinity may be manufactured by performing the ultraviolet light-irradiating process at room temperature instead of performing the heat treatment process at high temperatures.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of manufacturing a transition metal chalcogenide Thin film, the method comprising:

forming a transition metal chalcogenide precursor on a substrate;

drying the transition metal chalcogenide precursor at a temperature of 20° C. to 40° C.; and irradiating light onto the dried transition metal chalcogenide precursor at a temperature of 20° C. to 40° C. with a UV lamp, the light having a wavelength region of 180 nm to 500 nm and causing a decomposition of at least a portion of the transition metal chalcogenide precursor to form a crystallized area of the transition metal chalcogenide thin film on the substrate, wherein the transition metal chalcogenide thin film is formed without heating the precursor above 40° C.; and the transition metal chalcogenide precursor includes a material represented by:

$LMX_{n+m}$, wherein M is Mo, In, W, Hf, V, Sn, Re, Ta, Zn, Ga, Ge, Mn, As, Sb, Bi or Ti;

L is an amine-based ligand coordinated to M, the amine-based ligand being selected from the group consisting of $NH_4^+$, $N_2H_5^+$, $CH_3NH_3^+$, hydrazine, ethylenediamine, 2-aminoethanol, and a combination thereof;

X is S, Se or Te;

n is greater than 0 but less than or equal to 4; and m is greater than 0 but less than or equal to 12.

2. The method of claim 1, wherein the substrate is selected from the group consisting of a polymer including polyimide, polyethylene terephthalate, polyethylene naphthalate, polyphenyl sulfide, cyclic olefin copolymer, polyetherimide, polyarylate, nanocellulose, polydimethylsiloxane, polyamide, polycarbonate, polynorbornene, polyacrylate, polyvinyl alcohol, polyethersulfone, polystyrene, polypropylene, polyethylene, polybutylene terephthalate, polymethacrylate or combinations thereof, a ceramic including $SiO_2$, $Al_2O_3$, $ZrO_2$, $Si_3N_4$, SiC, AlN, $Fe_2O_3$, ZnO, BN or combinations thereof, and combinations thereof.

3. The method of claim 1, wherein the operation of forming the transition metal chalcogenide precursor includes patterning the transition metal chalcogenide precursor to form the transition metal chalcogenide thin film.

4. The method of claim 1, wherein the transition metal chalcogenide precursor is formed by a method selected from the group consisting of spin coating, bar coating, inkjet printing, nozzle printing, spray coating, slot die coating, gravure printing, screen printing, electrohydrodynamic jet printing, electrospray, and combinations thereof.

5. The method of claim 1, wherein the operation of forming the transition metal chalcogenide precursor is performed by applying a solution of the transition metal chalcogenide precursor onto the substrate.

6. The method of claim 5, wherein the solution is selected from the group consisting of ethylenediamine, 2-aminoethanol, dimethyl sulfoxide, dimethylformamide, N-methyl-2-pyrrolidone, 1,2-ethanedithiol, ethylene glycol, ether, DMF, THF, HMPA, and combinations thereof.

7. The method of claim 1, wherein the transition metal chalcogenide thin film includes a material represented by:

$MX_n$, wherein M is Mo, In, W, Hf, V, Sn, Re, Ta, Zn, Ga, Ge, Mn, As, Sb, Bi or Ti;

X is S, Se or Te, and n is greater than 0 but less than or equal to 4.

8. The method of claim 1, wherein an integrated circuit, an optoelectronic device, a sensor, or a wearable device comprises the transition metal chalcogenide thin film.

9. The method of claim 1, wherein the irradiating light has sufficient radiant power to separate the amine-based ligand from the transition metal chalcogenide precursor.

10. The method of claim 1, wherein M is Mo; and X is S.

11. A method of manufacturing a transition metal chalcogenide thin film, the method comprising:

forming a layer of a precursor material onto a heat-deformable polymer substrate, the precursor material comprising a transition metal chalcogenide precursor attached to an amine-based ligand;

drying the layer of the precursor material at a temperature of 20° C. to 40° C.; and decomposing at least a portion of the layer by separating the amine-based ligand from the precursor material in the portion of the layer by using a UV lamp to apply of light having radiant power sufficient to decompose the portion of the layer at a temperature of 20° C. to 40° C., thereby obtaining a crystalized area of the transition metal chalcogenide thin film without heat deforming the polymer substrate, wherein the transition metal chalcogenide precursor includes a material represented by:

$LMX_{n+m}$, wherein M is Mo, In, W, Hf, V, Sn, Re, Ta, Zn, Ga, Ge, Mn, As, Sb, Bi or Ti;

L is an amine-based ligand coordinated to M, the amine-based ligand being selected from the group consisting of $NH_4^+$, $N_2H_5^+$, $CH_3NH_3^+$, hydrazine, ethylenediamine, 2-aminoethanol, and a combination thereof;

X is S, Se or Te;

n is greater than 0 but less than or equal to 4; and m is greater than 0 but less than or equal to 12, wherein the crystalized area of the transition metal chalcogenide thin film is formed without heating the precursor material above 40°.

12. The method of claim 11, wherein the radiant power is supplied to the portion of the layer by the lamp located at a distance of about 20 cm from the portion of the layer.

13. The method of claim 11, wherein M is Mo; and X is S.

14. A method of manufacturing a transition metal chalcogenide thin film, the method comprising:

preparing a transition metal chalcogenide precursor solution by dissolving a transition metal chalcogenide precursor in a solvent, the transition metal chalcogenide precursor represented by:

$LMX_{n+m}$, wherein M is Mo, In, W, Hf, V, Sn, Re, Ta, Zn, Ga, Ge, Mn, As, Sb, Bi or Ti;

L is an amine-based ligand selected from the group consisting of $NH_4^+$, $N_2H_5^+$, $CH_3NH_3^+$, hydrazine, ethylenediamine, 2-aminoethanol, and a combination thereof;

X is S, Se or Te;

n is greater than 0 but less than or equal to 4; and m is greater than 0 but less than or equal to 12;

forming a layer of the transition metal chalcogenide precursor solution on a flexible substrate;

drying the layer of the transition metal chalcogenide precursor solution at a temperature of 20° C. to 40° C.; and irradiating light onto the dried thin layer of the transition metal chalcogenide precursor solution at a temperature of 20° C. to 40° C. with a UV lamp, the light having a wavelength region of 180 nm to 500 nm and causing a decomposition of at least a portion of the layer to form a crystallized area of the transition metal chalcogenide thin film on the flexible substrate, wherein the crystallized area of the transition metal chalcogenide thin film is obtained from the transition metal chalcogenide precursor solution prepared without heating the flexible substrate above 40° C.

15. The method of claim 14, wherein M is Mo; and X is S.

* * * * *